US010397702B2

(12) United States Patent
Lee

(10) Patent No.: US 10,397,702 B2
(45) Date of Patent: Aug. 27, 2019

(54) METHOD OF DETECTING EXTERNAL DEVICES AND ELECTRONIC DEVICE FOR PROCESSING SAME

(71) Applicant: Samsung Electronics Co., Ltd., Gyeonggi-do (KR)

(72) Inventor: Min Lee, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/225,224

(22) Filed: Aug. 1, 2016

(65) Prior Publication Data

US 2017/0064431 A1 Mar. 2, 2017

(30) Foreign Application Priority Data

Aug. 24, 2015 (KR) ..... 10-2015-0118745

(51) Int. Cl.
*H04R 3/04* (2006.01)
*H04R 5/04* (2006.01)

(52) U.S. Cl.
CPC ..... *H04R 5/04* (2013.01); *H04R 3/04* (2013.01); *H04R 2420/05* (2013.01)

(58) Field of Classification Search
CPC . H04M 1/6058; H04R 1/1016; H04R 1/1041; H04R 23/008; H04R 2420/09; H04S 5/00; H04S 5/02
See application file for complete search history.

(56) References Cited

U.S. PATENT DOCUMENTS 6,859,538 B1 2/2005 Voltz
2002/0037746 A1 3/2002 Osano
(Continued)

FOREIGN PATENT DOCUMENTS

EP 2 487 931 A2 8/2012
KR 10-1187143 B1 9/2012

OTHER PUBLICATIONS

International Search Report dated Nov. 30, 2016.
European Search Report dated Jul. 23, 2018.
European Search Report dated Jun. 5, 2019.

*Primary Examiner* — Mohammad K Islam
(74) *Attorney, Agent, or Firm* — Cha + Reiter, LLC

(57) ABSTRACT

Disclosed are a method of recognizing an external device and an electronic device for processing the method. The electronic device may include a memory configured to store at least one earphone polarity information; and a processor electrically coupled to the memory, wherein the processor executing instructions stored in the memory is configured to detect an insertion of earphones into a connector of the electronic device, acquire a first polarity information stored in the memory, based on the first polarity information, set a sound path for inputting or outputting a sound to or from the electronic device, determine a second polarity information corresponding to the inserted earphones, determine whether the first polarity information is compatible with the second polarity information, and reset the sound path based on the second polarity information when the first polarity information is not compatible with the second polarity information.

17 Claims, 14 Drawing Sheets

(56) References Cited

U.S. PATENT DOCUMENTS

| | | | | |
|---|---|---|---|---|
| 2006/0285677 | A1* | 12/2006 | Souma | H04M 1/6058 379/388.03 |
| 2012/0051562 | A1 | 3/2012 | Kim | |
| 2012/0290742 | A1 | 11/2012 | Sun et al. | |
| 2013/0051567 | A1* | 2/2013 | Gipson | H04R 29/00 381/56 |
| 2013/0064381 | A1* | 3/2013 | Jeong | H04R 5/04 381/58 |
| 2013/0142350 | A1 | 6/2013 | Larsen et al. | |
| 2013/0148819 | A1* | 6/2013 | You | H04R 3/00 381/74 |
| 2013/0208927 | A1* | 8/2013 | Wang | H04R 1/1041 381/306 |
| 2013/0320777 | A1* | 12/2013 | Nakanishi | H03K 17/94 307/130 |
| 2014/0029755 | A1* | 1/2014 | Kwon | H04S 7/308 381/58 |
| 2014/0100001 | A1 | 4/2014 | Im et al. | |
| 2014/0193024 | A1* | 7/2014 | Raff | H04R 1/02 381/394 |
| 2014/0301562 | A1 | 10/2014 | Tu et al. | |
| 2014/0321673 | A1* | 10/2014 | Seo | H04R 1/1041 381/123 |
| 2015/0106475 | A1* | 4/2015 | Tan | H04R 5/04 709/217 |
| 2015/0312674 | A1* | 10/2015 | Fukui | H04R 1/1083 381/151 |
| 2016/0044401 | A1* | 2/2016 | Lee | H04R 1/1041 381/74 |
| 2016/0337742 | A1* | 11/2016 | Li | H04R 1/1041 |
| 2017/0013346 | A1* | 1/2017 | Lee | H04R 1/1041 |

* cited by examiner

METHOD OF DETECTING EXTERNAL DEVICES AND ELECTRONIC DEVICE FOR PROCESSING SAME

CLAIM OF PRIORITY

This application claims priority under 35 U.S.C. § 119(a) to Korean Application Serial No. 10-2015-0118745, which was filed in the Korean Intellectual Property Office on Aug. 24, 2015, the entire content of which is hereby incorporated by reference.

TECHNICAL FIELD

The present disclosure relates to an apparatus and a method for detecting external devices and, more particularly to, a method of controlling a sound path (for example, an input audio path, an output audio path, or an input/output audio path) of external devices, such as earphones and microphones, and an electronic device for supporting the same.

BACKGROUND

Due to the recent rapid development of electronic devices such as mobile devices and smartphones, electronic devices which can perform wireless voice calls and exchange information such as Internet data have become daily necessities for a large number of users. With the development of technology and introduction of wireless Internet, these electronic devices have gradually broadened its features to a wide variety of applications including games, calendar, still image and video recording, etc., in addition to wireless voice calls.

Generally, earphones are provided as an accessory of the electronic device to output audio when, for example, the user is using an audio or video playback application of the electronic device. Earphones may also sometimes come equipped with a microphone, so that the earphones are capable of outputting a counterparty's voice audio data as well as inputting the user's voice audio data when the user is using the electronic device to make a wireless voice call with the counterparty.

When the earphones are inserted into the electronic device, the electronic device may identify the type of the inserted earphones and set an appropriate sound path for the identified earphones.

For example, the electronic device may detect whether the inserted earphones are microphone type earphones or non-microphone type earphone. When the inserted earphones are detected as the microphone type earphones, the electronic device may determine the sound input device as the microphone of the earphones and determine the sound output device as the speaker of the earphones. An appropriate sound path may be set by the electronic device to output sound to the speaker of the earphones and input sound from the microphone of the earphones. In another example, when the inserted earphones are detected as the non-microphone type earphones, the electronic device may determine the sound input device as the microphone included in the electronic device and determine the sound output device as the speaker of the earphones. An alternative sound path may be set by the electronic device to output sound to the speaker of the earphones and input sound from the microphone included in the electronic device.

SUMMARY

In general, it takes a predetermined time to set a sound path corresponding to a type of earphones inserted into an electronic device. For example, it takes a predetermined time to identify the type of earphones, which causes a delay to complete the setting of the sound path.

Various embodiments of the present disclosure may provide an apparatus and a method for solving the above-mentioned delay when a sound path of an external device, for example, earphones, is set when the earphones are inserted into the electronic device.

In accordance with an aspect of the present disclosure, an electronic device is provided. The electronic device includes: a memory configured to store at least one earphone polarity information; and a processor electrically coupled to the memory, wherein the processor may be configured to detect insertion of earphones into a connector of the electronic device, to acquire a first polarity information stored in the memory, based on the first polarity information, to set a sound path for inputting or outputting a sound to or from the electronic device, to determine a second polarity information corresponding to the inserted earphones, to determine whether the first polarity information is compatible with the second polarity information, and to reset the sound path based on the second polarity information when the first polarity information is not compatible with the second polarity information.

In accordance with another aspect of the present disclosure, a method of recognizing earphones is provided. The method includes: detecting an insertion of earphones into a connector of an electronic device; and setting a sound path for inputting or outputting a sound to or from the electronic based on a predetermined polarity information. In accordance with another aspect of the present disclosure, an electronic device is provided. The electronic device includes: a memory for storing at least one earphone polarity information; and a processor electrically coupled to the memory, wherein the processor detects an insertion of earphones into a connector of the electronic device, acquires a first polarity information stored in the memory, and displays the first polarity information on a screen of the electronic device.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
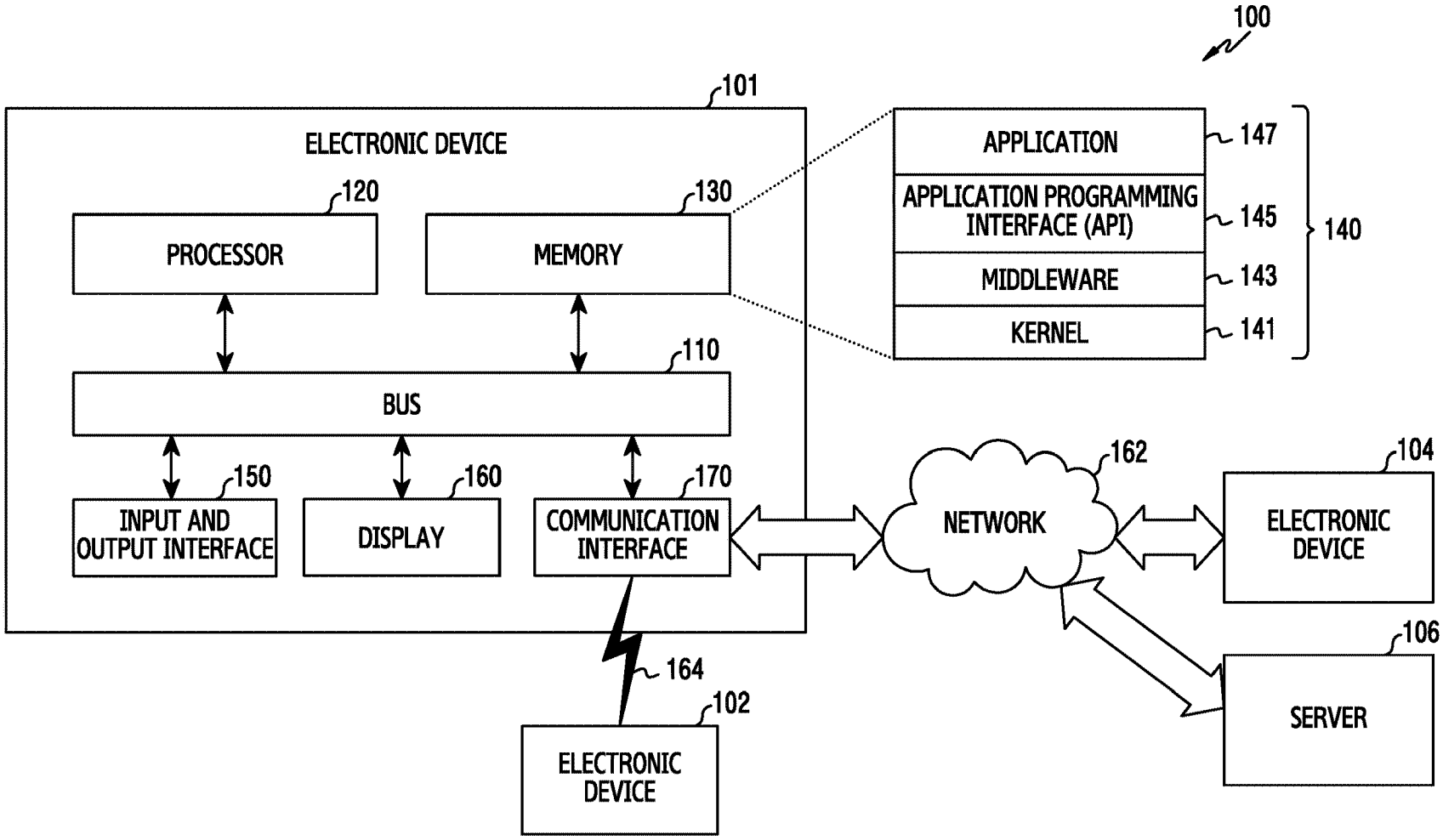
FIG. 1 illustrates an electronic device within a network environment according to various embodiments of the present disclosure.

Hereinafter, various embodiments of the present disclosure will be described with reference to the accompanying drawings. In the following description, specific details such as detailed configuration and components are merely provided to assist the overall understanding of these embodiments of the present disclosure. Therefore, it should be apparent to those skilled in the art that various changes and modifications of the embodiments described herein can be made without departing from the scope and spirit of the present disclosure. In addition, descriptions of well-known functions and constructions are omitted for clarity and conciseness.

The present disclosure may have various embodiments, and modifications and changes may be made therein. Therefore, the present disclosure will be described in detail with reference to particular embodiments shown in the accompanying drawings. However, it should be understood that the present disclosure is not limited to the particular embodiments, but includes all modifications/changes, equivalents, and/or alternatives falling within the spirit and the scope of the present disclosure. In describing the drawings, similar reference numerals may be used to designate similar elements.

The terms "have", "may have", "include", or "may include" used in the various embodiments of the present disclosure indicate the presence of disclosed corresponding functions, operations, elements, and the like, and do not limit additional one or more functions, operations, elements, and the like. In addition, it should be understood that the terms "include" or "have" used in the various embodiments of the present disclosure are to indicate the presence of features, numbers, steps, operations, elements, parts, or a combination thereof described in the specifications, and do not preclude the presence or addition of one or more other features, numbers, steps, operations, elements, parts, or a combination thereof.

The terms "A or B", "at least one of A or/and B" or "one or more of A or/and B" used in the various embodiments of the present disclosure include any and all combinations of words enumerated with it. For example, "A or B", "at least one of A and B" or "at least one of A or B" means (1) including at least one A, (2) including at least one B, or (3) including both at least one A and at least one B.

Although the term such as "first" and "second" used in various embodiments of the present disclosure may modify various elements of various embodiments, these terms do not limit the corresponding elements. For example, these terms do not limit an order and/or importance of the corresponding elements. These terms may be used for the purpose of distinguishing one element from another element. For example, a first user device and a second user device all indicate user devices and may indicate different user devices. For example, a first element may be named a second element without departing from the scope of right of various embodiments of the present disclosure, and similarly, a second element may be named a first element.

It will be understood that when an element (e.g., first element) is "connected to" or "(operatively or communicatively) coupled with/to" to another element (e.g., second element), the element may be directly connected or coupled to another element, and there may be an intervening element (e.g., third element) between the element and another element. To the contrary, it will be understood that when an element (e.g., first element) is "directly connected" or "directly coupled" to another element (e.g., second element), there is no intervening element (e.g., third element) between the element and another element.

The expression "configured to (or set to)" used in various embodiments of the present disclosure may be replaced with "suitable for", "having the capacity to", "designed to", "adapted to", "made to", or "capable of" according to a situation. The term "configured to (set to)" does not necessarily mean "specifically designed to" in a hardware level. Instead, the expression "apparatus configured to . . . " may mean that the apparatus is "capable of . . . " along with other devices or parts in a certain situation. For example, "a processor configured to (set to) perform A, B, and C" may be a dedicated processor, e.g., an embedded processor, for performing a corresponding operation, or a generic-purpose processor, e.g., a Central Processing Unit (CPU) or an application processor (AP), capable of performing a corresponding operation by executing one or more software programs stored in a memory device.

The terms as used herein are used merely to describe certain embodiments and are not intended to limit the present disclosure. As used herein, singular forms may include plural forms as well unless the context explicitly indicates otherwise. Further, all the terms used herein, including technical and scientific terms, should be interpreted to have the same meanings as commonly understood by those skilled in the art to which the present disclosure pertains, and should not be interpreted to have ideal or excessively formal meanings unless explicitly defined in various embodiments of the present disclosure.

An electronic device according to various embodiments of the present disclosure may be a device. For example, the electronic device according to various embodiments of the present disclosure may include at least one of: a smart phone; a tablet personal computer (PC); a mobile phone; a video phone; an e-book reader; a desktop PC; a laptop PC; a netbook computer; a workstation, a server, a personal digital assistant (PDA); a portable multimedia player (PMP); an MP3 player; a mobile medical device; a camera; or a wearable device (e.g., a head-mount-device (HMD), an electronic glasses, an electronic clothing, an electronic bracelet, an electronic necklace, an electronic appcessory, an electronic tattoo, a smart mirror, or a smart watch).

In other embodiments, an electronic device may be a smart home appliance. For example, of such appliances may include at least one of: a television (TV); a digital video disk (DVD) player; an audio component; a refrigerator; an air conditioner; a vacuum cleaner; an oven; a microwave oven; a washing machine; an air cleaner; a set-top box; a home automation control panel; a security control panel; a TV box (e.g., Samsung HomeSync™, Apple TV™, or Google TV™); a game console (e.g., Xbox™, PlayStation™); an electronic dictionary; an electronic key; a camcorder; or an electronic frame.

In other embodiments, an electronic device may include at least one of: a medical equipment (e.g., a mobile medical device (e.g., a blood glucose monitoring device, a heart rate monitor, a blood pressure monitoring device or a temperature meter), a magnetic resonance angiography (MRA) machine, a magnetic resonance imaging (MRI) machine, a computed tomography (CT) scanner, or an ultrasound machine); a navigation device; a global positioning system (GPS) receiver; an event data recorder (EDR); a flight data recorder (FDR); an in-vehicle infotainment device; an electronic equipment for a ship (e.g., ship navigation equipment and/or a gyrocompass); an avionics equipment; a security equipment; a head unit for vehicle; an industrial or home robot; an automatic teller's machine (ATM) of a financial institution, point of sale (POS) device at a retail store, or an internet of things device (e.g., a Lightbulb, various sensors, an electronic meter, a gas meter, a sprinkler, a fire alarm, a thermostat, a streetlamp, a toaster, a sporting equipment, a hot-water tank, a heater, or a boiler and the like)

In certain embodiments, an electronic device may include at least one of: a piece of furniture or a building/structure; an electronic board; an electronic signature receiving device; a projector; and various measuring instruments (e.g., a water meter, an electricity meter, a gas meter, or a wave meter).

An electronic device according to various embodiments of the present disclosure may also include a combination of one or more of the above-mentioned devices. Further, it will be apparent to those skilled in the art that an electronic device according to various embodiments of the present disclosure is not limited to the above-mentioned devices.

FIG. 1 is a view illustrating a network environment 100 including an electronic device 101 according to various embodiments. Referring to FIG. 1, the electronic device 101 may include a bus 110, a processor 120, a memory 130, an input/output (I/O) interface 150, a display 160, and a communication interface 170.

The bus 110 may be a circuit for connecting the above-described elements (e.g., the processor 120, the memory 130, the I/O interface 150, the display 160 or the communication interface 170, etc.) with each other, and transferring communication (e.g., a control message) between the above-described elements.

The processor 120 may include a central processing unit (CPU), a communication processor (CP), or a graphic processing unit (GPU). An artisan understands and appreciates that a "processor" or "microprocessor" constitute hardware in the claimed invention. Under the broadest reasonable interpretation, the appended claims constitute statutory subject matter in compliance with 35 U.S.C. § 101. In addition, a processor as described herein may include a microprocessor or any suitable type of processing circuitry, such as one or more general-purpose processors (e.g., ARM-based processors), a Digital Signal Processor (DSP), a Programmable Logic Device (PLD), an Application-Specific Integrated Circuit (ASIC), a Field-Programmable Gate Array (FPGA), a Graphical Processing Unit (GPU), a video card controller, etc.

The processor 120 may receive, for example, an instruction from the above-described other elements (e.g., the memory 130, the I/O interface 150, the display 160, or the communication interface 170, etc.) via the bus 110, decipher the received instruction, and execute an operation or a data process corresponding to the deciphered instruction.

The memory 130 may include any suitable type of volatile or non-volatile memory. The memory 130 may store an instruction or data received from the processor 120 or other elements (e.g., the I/O interface 150, the display 160, or the communication interface 170, etc.), or generated by the processor 120 or other elements. The memory 130 may include, for example, programming modules 140 such as a kernel 141, a middleware 143, an application programming interface (API) 145, or an application 147. The each of the programming modules may be configured using a software, a firmware, a hardware, or a combination of two or more of these. The terms "unit" or "module" referred to herein is to be understood as comprising hardware such as a processor or microprocessor configured for a certain desired functionality, or a non-transitory medium comprising machine executable code, in accordance with statutory subject matter under 35 U.S.C. § 101 and does not constitute only software per se.

The kernel 141 may control or manage system resources (e.g., the bus 110, the processor 120, or the memory 130, etc. and/or other hardware and software resources) used for executing an operation or a function implemented in the rest of the programming modules, for example, the middleware 143, the API 145, or the application 147. Also, the kernel 141 may provide an interface for allowing the middleware 143, the API 145, or the application 147 to access an individual element of the electronic device 101 and control or manage the same.

The middleware 143 may perform a mediation role so that the API 145 or the application 147 may communicate with the kernel 141 to give and take data. Also, in connection with task requests received from the applications 147, the middleware 143 may perform a control (e.g., scheduling or load balancing) for a task request using, for example, a method of assigning priority that may use a system resource (e.g., the bus 110, the processor 120, or the memory 130, etc.) of the electronic device 101 to at least one application 134.

The API 145 is an interface for allowing the application 147 to control a function provided by the kernel 141 or the middleware 143, and may include at least one interface or function (e.g., an instruction) for file control, window control, image processing, or character control, etc.

The I/O interface 150 may transfer an instruction or data input from a user via an I/O unit (e.g., a sensor, a keyboard, a mouse, or a touchscreen) to the processor 120, the memory 130, or the communication interface 170 via the bus 110, for example. For example, the I/O interface 150 may provide data regarding a user's touch input via the touchscreen to the processor 120. Also, the I/O interface 150 may, for example, output an instruction or data received via the bus 110 from the processor 120, the memory 130, or the communication interface 170 via the I/O unit (e.g., a speaker or a display). For example, the I/O interface 150 may output voice data processed by the processor 120 to a user via a speaker.

The display 160 may include, for example, a Liquid Crystal Display (LCD), a Light Emitting Diode (LED)

display, an Organic Light Emitting Diode (OLED) display, a Micro Electro Mechanical System (MEMS) display, or an electronic paper display. The display 160 may display various types of contents (for example, text, images, videos, icons, or symbols) for users. The display 160 may include a touch screen, and may receive, for example, a touch, gesture, proximity, or hovering input by using an electronic pen or a part of the user's body using capacitive, resistive, or another type of technology.

The communication interface 170 may connect communication between the electronic device 101 and an external device (for example, the electronic device 104 or the server 106). For example, the communication interface 170 may be connected to a network 162 through wireless communication or wired communication, and may communicate with an external electronic device 102 or 104 or an external server 106.

The wireless communication may use at least one of, for example, Long Term Evolution (LTE), LTE-Advance (LTE-A), Code Division Multiple Access (CDMA), Wideband CDMA (WCDMA), Universal Mobile Telecommunications System (UMTS), WiBro (Wireless Broadband), and Global System for Mobile Communications (GSM) as a cellular communication protocol.

The wired communication may include, for example, at least one of universal serial bus (USB), high definition multimedia interface (HDMI), recommended standard 232 (RS-232), and plain old telephone service (POTS).

The network 162 may include at least one of communication networks such as a computer network (for example, a LAN or a WAN), the Internet, and a telephone network.

The electronic devices 102 and 104 may be devices of the same type as that the electronic device 101 or devices of different types from that of the electronic device 101. According to an embodiment, the server 106 may include a group of one or more servers. According to one embodiment, all or some of the operations executed in the electronic device 101 may be carried out in another electronic device or a plurality of electronic devices (for example, the electronic device 102 or 104 and the server 106). According to an embodiment, when the electronic device 101 should perform some functions or services automatically or by a request, the electronic device 101 may make a request for performing at least some functions related to the functions or services to another device (for example, the electronic device 102 or 104, or the server 106) instead of performing the functions or services by itself or additionally. The electronic device (for example, the electronic device 102 or 104, or the server 106) may carry out the functions requested by the electronic device 101 or additional functions and provide results thereof to the electronic device 101. The electronic device 101 may provide the requested functions or services to another electronic device based on the received results or after additionally processing the received results. To this end, for example, cloud computing, distributed computing, or client-server computing technology may be used.

Figure 2:
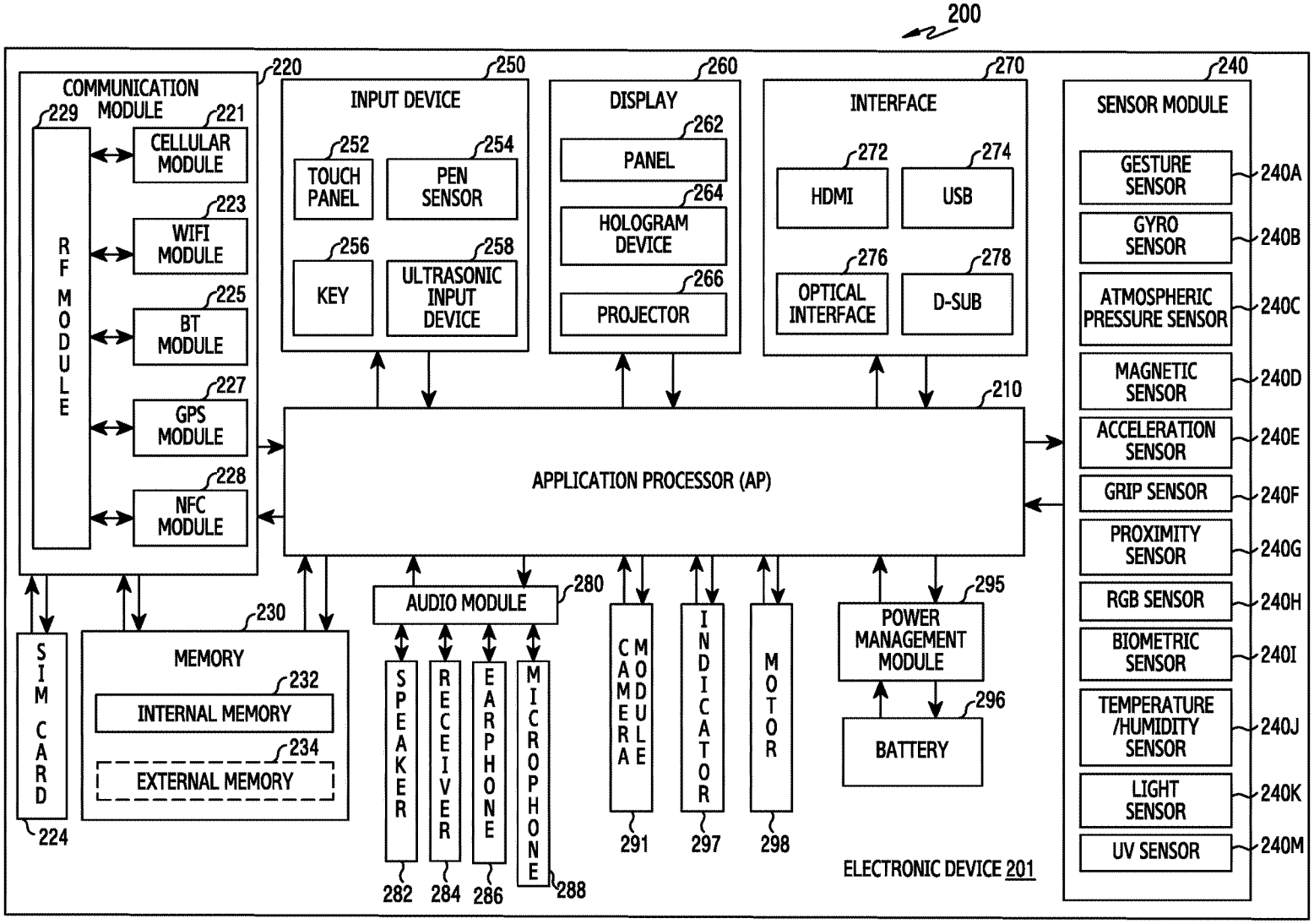
FIG. 2 is a block diagram of an electronic device according to various embodiments of the present disclosure.

FIG. 2 is a block diagram 200 illustrating an electronic device 201 according to various embodiments of the present invention. The electronic device 201 may be configured as, for example, all or a portion of the electronic device 21 illustrated in FIG. 1. Referring to FIG. 2, the electronic device 201 may include one or more application processors (AP) 210, a communication module 220, a subscriber identification module (SIM) card 224, a memory 230, a sensor module 240, an input unit 250, a display 260, an interface 270, an audio module 280, a camera module 291, a power management module 295, a battery 296, an indicator 297, or a motor 298.

The AP 210 may drive an OS or an application to control a plurality of hardware or software elements connected to the AP 210, and perform various data processes including multimedia data and operations. The AP 210 may be implemented, for example, as a system on chip (SoC). According to an embodiment, the AP 210 may further include at least one of a graphic processing unit (GPU) or image signal processor. According to an embodiment, the AP 210 may be implemented to include at least a portion (e.g., the cellular module 221) of the above-described elements. Also, the AP 210 may store data received from at least one of the other elements or generated by at least one of the other elements in a memory, which may be non-volatile.

The communication module 220 (e.g., the communication interface 170) may perform data transmission/reception in communication between the electronic device 201 (e.g., the electronic device 21) and other electronic devices (e.g., the electronic device 24 or the server 26) connected via a network. According to an embodiment, the communication module 220 may include a cellular module 221, a Wi-Fi module 223, a BT module 225, a GPS module 227, an NFC module 228, and a Radio Frequency (RF) module 229.

The cellular module 221 may provide voice communication, image communication, a short message service, or an Internet service, etc. via a communication network (e.g., LTE, LTE-A, CDMA, WCDMA, UMTS, WiBro, or GSM, etc.). Also, the cellular module 221 may perform discrimination and authentication of an electronic device within a communication network using, for example, a subscriber identify module (e.g., a SIM card 224). According to an embodiment, the cellular module 221 may perform at least a portion of functions that may be provided by the AP 210. According to an embodiment, the cellular module 221 may include a communication processor (CP). Also, the cellular module 221 may be, for example, implemented as a SoC. Though elements such as the cellular module 221 (e.g., a communication processor), the memory 230, or the power management module 295, etc. are illustrated as elements separated from the AP 210 in FIG. 2, according to an embodiment, the AP 210 may be implemented to include at least a portion (e.g., the cellular module 221) of the above-described elements.

Each of the Wi-Fi module 223, the BT module 225, the GPS module 227, or the NFC module 228 may include, for example, a processor for processing data transmitted/received via a relevant module. Though the cellular module 221, the Wi-Fi module 223, the BT module 225, the GPS module 227, or the NFC module 228 are illustrated as separate blocks in FIG. 2, according to an embodiment, at least a portion (e.g., two or more elements) of the cellular module 221, the Wi-Fi module 223, the BT module 225, the GPS module 227, or the NFC module 228 may be included in one Integrated Circuit (IC) or an IC package. For example, at least a portion (e.g., a communication processor corresponding to the cellular module 221 and a Wi-Fi processor corresponding to the Wi-Fi module 223) of processors corresponding to each of the cellular module 221, the Wi-Fi module 223, the BT module 225, the GPS module 227, or the NFC module 228 may be implemented as one SoC.

The RF module 229 may perform transmission/reception of data, for example, transmission/reception of an RF signal. The RF module 229 may include, for example, a transceiver, a power amp module (PAM), a frequency filter, or a low noise amplifier (LNA), etc., though not shown. Also, the RF module 229 may further include a part for transmitting/receiving an electromagnetic wave on a free space in wireless communication, for example, a conductor or a conducting line, etc. Though FIG. 2 illustrates the cellular module 221, the Wi-Fi module 223, the BT module 225, the GPS module 227, and the NFC module 228 share one RF module 229, according to an embodiment, at least one of the cellular module 221, the Wi-Fi module 223, the BT module 225, the GPS module 227, or the NFC module 228 may perform transmission/reception of an RF signal via a separate RF module.

The SIM card 224 may be a card including a subscriber identify module, and may be inserted into a slot formed in a specific position of the electronic device. The SIM card 224 may include unique identify information (e.g., integrated circuit card identifier (ICCID)) or subscriber information (e.g., international mobile subscriber identity (IMSI)).

The memory 230 (e.g., the memory 20) may include a built-in memory 232 or an external memory 234. The built-in memory 232 and the external memory 234 may include, for example, at least one of a volatile memory (e.g., dynamic RAM (DRAM), static RAM (SRAM), synchronous dynamic RAM (SDRAM)) and a non-volatile memory (e.g., one time programmable ROM (OTPROM), programmable ROM (PROM), erasable and programmable ROM (EPROM), electrically erasable and programmable ROM (EEPROM), mask ROM, flash ROM, NAND flash memory, NOR flash memory, etc.).

According to an embodiment, the built-in memory 232 may be a non-volatile Solid State Drive (SSD). The external memory 234 may further include a non-volatile flash drive, for example, compact flash (CF), secure digital (SD), micro secure digital (Micro-SD), mini secure digital (Mini-SD), extreme digital (xD), or a memory stick. The external memory 234 may be functionally connected with the electronic device 201 via various interfaces. According to an embodiment, the electronic device 201 may further include a storage device (or a storage medium) such as a hard drive.

The sensor module 240 may measure a physical quantity or detect an operation state of the electronic device 201, and convert the measured or detected information to an electric signal. The sensor module 240 may include, for example, at least one of a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (e.g., RGB (red, green, blue) sensor), a living body sensor 240I, a temperature/humidity sensor 240J, an illuminance sensor 240K, or an ultra violet (UV) sensor 240M. Additionally or alternatively, the sensor module 240 may include, for example, an E-nose sensor (not shown), an electromyography (EMG) sensor (not shown), an electroencephalogram (EEG) sensor (not shown), an electrocardiogram (ECG) sensor (not shown), an infrared (IR) sensor (not shown), an iris sensor (not shown), or a fingerprint sensor (not shown), etc. The sensor module 240 may further include a control circuit for controlling at least one sensor belonging thereto.

The input unit 250 may include a touch panel 252, a (digital) pen sensor 254, a key 256, or an ultrasonic input unit 258. The touch panel 252 may recognize a touch input using at least one of capacitive, resistive, infrared, or ultrasonic methods. Also, the touch panel 252 may further include a control circuit. A capacitive touch panel may perform detection by a physical contact or proximity recognition. The touch panel 252 may further include a tactile layer. In this case, the touch panel 252 may provide a tactile reaction to a user.

The (digital) pen sensor 254 may be implemented using, for example, a method which is the same as or similar to receiving a user's touch input, or using a separate sheet for detection. The key 256 may include, for example, a physical button, an optical key or keypad. The ultrasonic input unit 258 is a unit for recognizing data by detecting a sound wave using a microphone (e.g., a microphone 288) in the electronic device 201 via an input tool generating an ultrasonic signal, and enables wireless recognition. According to an embodiment, the electronic device 201 may receive a user input from an external device (e.g., a computer or a server) connected to the communication module 220 using the communication module 220.

The display 260 (e.g., the display 150) may include a panel 262, a hologram device 264, or a projector 266. The panel 262 may be, for example, a liquid crystal display (LCD), or an active-matrix organic light-emitting diode (AM-OLED), etc. The panel 262 may be implemented, for example, such that it is flexible, transparent, or wearable. The panel 262 may be configured as one module together with the touch panel 252. The hologram device 264 may show a three-dimensional image in the air using interferences of light. The projector 266 may project light onto a screen to display an image. The screen may be positioned, for example, inside or outside the electronic device 201. According to an embodiment, the display 260 may further include a control circuit for controlling the panel 262, the hologram device 264, or the projector 266.

The interface 270 may include, for example, a high-definition multimedia interface (HDMI) 272, a universal serial bus (USB) 274, an optical interface 276, or a D-sub-miniature (D-sub) 278. The interface 270 may be included, for example, in the communication interface 160 illustrated in FIG. 1. Additionally or alternatively, the interface 270 may include, for example, a mobile high-definition link (MHL) interface, a secure digital (SD) card/multi-media card (MMC) interface, or an infrared data association (IrDA) standard interface.

The audio module 280 may convert a sound and an electric signal in dual directions. At least a partial element of the audio module 280 may be included, for example, in the I/O interface 150 illustrated in FIG. 1. The audio module 280 may process sound information input or output via, for example, a speaker 282, a receiver 284, an earphone 286, or a microphone 288, etc.

The camera module 291 is a device that may shoot a still image and a moving picture. According to an embodiment, the camera module 291 may include one or more image sensors (e.g., a front sensor or a rear sensor), a lens (not shown), an image signal processor (ISP) (not shown), or a flash (not shown) (e.g., an LED or xenon lamp).

The power management module 295 may manage power of the electronic device 201. Though not shown, the power management module 295 may include, for example, a power management integrated circuit (PMIC), a charger integrated circuit (IC), or a battery or a battery or fuel gauge.

The PMIC may be mounted, for example, inside an integrated circuit or a SoC semiconductor. A charging method may be classified into a wired charging method and a wireless charging method. The charging IC may charge a battery and prevent introduction of an overvoltage or an overcurrent from a charger. According to an embodiment, the charging IC may include a charging IC for at least one of the wired charging method and the wireless charging method. The wireless charging method may be, for example, a magnetic resonance method, a magnetic induction method, or an electromagnetic wave method, etc., and may additionally include an additional circuit for wireless charging, for example, a circuit such as a coil loop, a resonance circuit, or a rectifier, etc.

The battery gauge may measure, for example, a remnant of the battery 296, a voltage, a current, or a temperature while charging. The battery 296 may store or generate electricity, and supply power to the electronic device 201 using the stored or generated electricity. The battery 296 may include, for example, a rechargeable battery or a solar battery.

The indicator 297 may display a specific state of the electronic device 201 or a portion thereof (e.g., the AP 210), for example, a booting state, a message state, or a charging state, etc. The motor 298 may convert an electric signal to mechanical vibration. Though not shown, the electronic device 201 may include a processor (e.g., a GPU) for supporting a mobile TV. The processor for supporting the mobile TV may process media data corresponding to standards, for example, such as digital multimedia broadcasting (DMB), digital video broadcasting (DVB), or a media flow, etc.

The aforementioned elements of the electronic device according to various embodiments of the present disclosure may be constituted by one or more components, and the name of the corresponding element may vary with a type of electronic device. The electronic device according to various embodiments of the present disclosure may include at least one of the aforementioned elements. Some elements may be omitted or other additional elements may be further included in the electronic device. Further, some of the components of the electronic device according to the various embodiments of the present disclosure may be combined to form a single entity, and thus, may equivalently execute functions of the corresponding elements prior to the combination.

Figure 3:
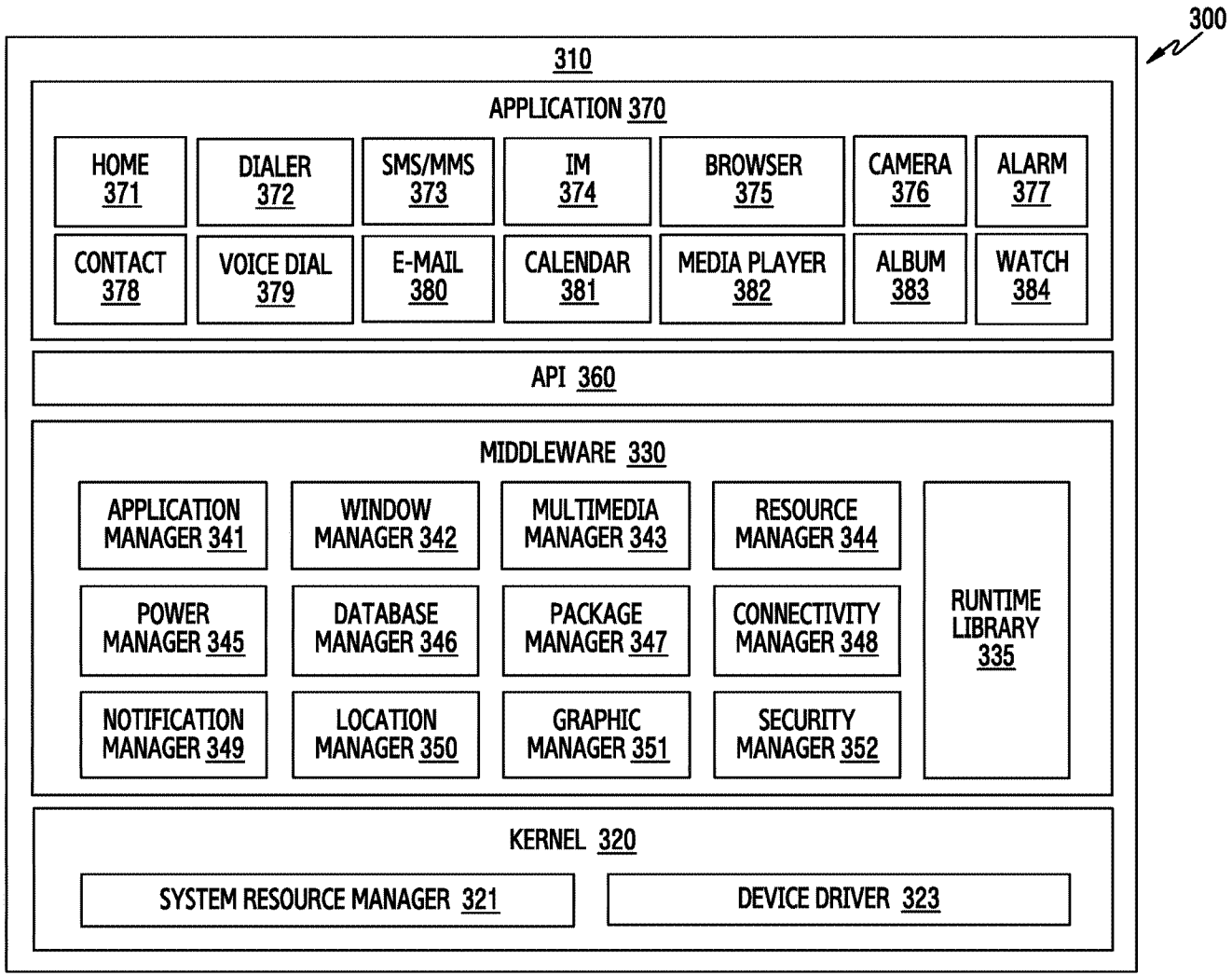
FIG. 3 is a block diagram of a program module according to various embodiments of the present disclosure.

FIG. 3 is a block diagram 300 of a program module 310 according to various embodiments of the present invention.

According to an embodiment, the program module 310 (for example, the programs 140) may include an Operating System (OS) for controlling resources related to the electronic device (for example, the electronic device 101) and/or various applications (for example, the application programs 147) executed in the operating system. The operating system may be, for example, Android, iOS, Windows, Symbian, Tizen, Bada, or the like.

The programming module 310 may include a kernel 320, middleware 330, an API 360, and/or applications 370. At least some of the program module 310 may be preloaded in the electronic device or downloaded from the server.

The kernel 320 (for example, the kernel 141 of FIG. 1) may include, for example, a system resource manager 331 or a device driver 333. The system resource manager 331 may control, allocate, or collect the system resources. According to an embodiment, the system resource manager 331 may include a process management unit, a memory management unit, or a file system management unit. The device driver 333 may include, for example, a display driver, a camera driver, a Bluetooth driver, a shared-memory driver, a USB driver, a keypad driver, a WiFi driver, an audio driver, or an Inter-Process Communication (IPC) driver.

According to various embodiments, at least one module (for example, device driver 323) included in the kernel 320 may perform an operation of providing first polarity information (for example, predetermined earphone polarity information and earphone polarity information used before an earphone insertion is detected), and earphone characteristic information (for example, earphone identifier) to the middleware 330 in accordance with detection of the earphone insertion. According to various embodiments, at least one module (for example, device driver 323) included in the kernel 320 may perform an operation of identifying second polarity information (for example, polarity information of the inserted earphones) and providing the second polarity information to the middleware 330. According to various embodiments, at least one module (for example, device driver 323) included in the middleware 330 may perform an operation of setting or changing a sound path and setting a sound effect in accordance with a command provided by the middleware 330.

The middleware 330 may provide a function required by the applications 370 in common or provide various functions to the applications 370 through the API 360 so that the applications 370 can efficiently use limited system resources within the electronic device. According to an embodiment, the middleware 330 (for example, the middleware 143) may include, for example, at least one of a runtime library 335, an application manager 341, a window manager 342, a multimedia manager 343, a resource manager 344, a power manager 345, a database manager 346, a package manager 347, a connectivity manager 348, a notification manager 349, a location manager 350, a graphic manager 351, and a security manager 352.

The runtime library 335 may include, for example, a library module that a compiler uses to add new functions through a programming language while the application 370 is executed. The runtime library 335 may perform input/output management, memory management, or a function for an arithmetic function.

The application manager 341 may manage, for example, a life cycle of at least one of the applications 370. The window manager 342 may manage Graphical User Interface (GUI) resources used by a screen. The multimedia manager 343 may grasp formats required for the reproduction of various media files, and may perform an encoding or decoding of the media file by using a codec suitable for the corresponding format. The resource manager 344 may manage resources such as a source code, a memory, and a storage space of at least one of the applications 370.

The power manager 345 may operate together with a Basic Input/Output System (BIOS) to manage a battery or power and may provide power information required for the operation of the electronic device. The database manager 346 may generate, search for, or change a database to be used by at least one of the applications 370. The package manager 347 may manage the installation or the updating of applications distributed in the form of package file.

The connectivity manager 348 may manage wireless connection of, for example, Wi-Fi or Bluetooth. The notification manager 349 can display or notify of an event such as an arrival message, promise, proximity notification, and the like in such a way that does not disturb a user. The location manager 350 may manage location information of the electronic device. The graphic manager 351 may manage graphic effects to be provided to a user and user interfaces related to the graphic effects. The security manager 352 may provide all security functions required for system security or user authentication. According to an embodiment, when the electronic device (for example, electronic device 101) has a call function, the middleware 330 may further include a telephony manager for managing a voice call function or a video call function of the electronic device.

According to various embodiments, at least one module (for example, resource manager 344) included in the middleware 330 may perform an operation of setting or changing a sound path and setting a sound effect in accordance with reception of earphone polarity information and earphone characteristic information (for example, earphone identifier) from the kernel 320. According to various embodiments, at least one module (for example, resource manager 344 or notification manager 349) included in the middleware 330 may perform an operation of displaying earphone polarity information received from the kernel 320 on the screen.

The middleware 330 may include a middleware module for forming a combination of various functions of the aforementioned components. The middleware 330 may provide modules specialized according to types of operating systems in order to provide differentiated functions. Further, the middleware 330 may dynamically remove some of the existing components or add new components.

The API 360 (for example, the API 145) is, for example, a set of API programming functions, and a different configuration thereof may be provided according to an operating system. For example, Android or iOS may provide one API set per platform, and Tizen may provide two or more API sets per platform.

The applications 370 (for example, the application programs 147) may include, for example, one or more applications which can provide functions such as home 371, dialer 372, SMS/MMS 373, Instant Message (IM) 374, browser 375, camera 376, alarm 377, contacts 378, voice dialer 379, email 380, calendar 381, media player 382, album 383, clock 384, health care (for example, measure exercise quantity or blood sugar), or environment information (for example, atmospheric pressure, humidity, or temperature information).

According to an embodiment, the applications 370 may include an application (hereinafter, referred to as an "information exchange application" for convenience of the description) supporting information exchange between the electronic device (for example, the electronic device 101) and an external electronic device. The information exchange application may include, for example, a notification relay application for transferring predetermined information to an external electronic device or a device management application for managing an external electronic device.

For example, the notification relay application may include a function of transferring, to the external electronic device, notification information generated from other applications of the electronic device 101 (for example, an SMS/MMS application, an e-mail application, a health management application, or an environmental information application). Further, the notification relay application may receive notification information from, for example, a control device and provide the received notification information to the user. The device management application may manage (for example, install, delete, or update), for example, a function for at least a part of the external electronic device communicating with the electronic device (for example, turning on/off the external electronic device itself (or some elements thereof) or adjusting brightness (or resolution) of a display), applications executed in the external electronic device, or services provided from the external electronic device (for example, a telephone call service or a message service).

According to an embodiment, the applications 370 may include an application (for example, health management application) designated according to attributes of the external electronic device (for example, attributes of the electronic device such as the type of electronic device which corresponds to a mobile medical device). According to an embodiment, the applications 370 may include an application received from the external electronic devices (for example, the server or the electronic device). According to an embodiment, the applications 370 may include a preloaded application or a third party application which can be downloaded from the server. The names of the components of the program module 310 according to the embodiment illustrated in FIG. 3 may vary according to the type of operating system.

According to various embodiments, at least some of the programming module 310 may be implemented by software, firmware, hardware, or a combination of two or more thereof. At least some of the programming module 310 may be implemented (for example, executed) by, for example, the processor (for example, the application program). At least some of the programming module 310 may include, for example, a module, program, routine, sets of instructions, or process for performing one or more functions.

Figure 4A:
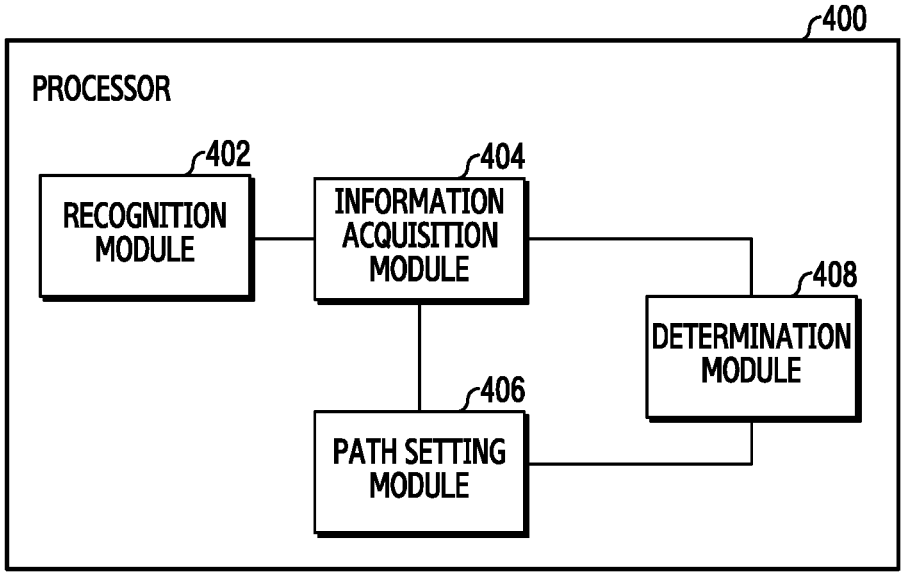
FIG. 4A illustrates a configuration of a processor according to one embodiment of the present disclosure.

FIG. 4A illustrates a configuration of a processor 400 of the electronic device according to one embodiment of the present disclosure. According to one embodiment, the processor 400 may be the processor (for example, the processor 120) of the electronic device (for example, the electronic device 101).

According to one embodiment, the processor 400 may include a recognition module 402, an information acquisition module 404, a path setting module 406, and a determination module 408.

The recognition module 402 may detect the insertion of earphones. According to one embodiment, the recognition module 402 may detect insertion of an earphone plug of at least one polarity (for example, 3-pole earphone plug or 4-pole earphone plug) from a pair of earphones into a connector (for example, earphone plug socket of the electronic device). According to an embodiment, the recognition module 420 may detect a recognition signal generated from a recognition terminal (for example, a recognition terminal of the connector) that contacts at least one polarity of the inserted earphone plug, so as to detect insertion of earphones and recognize the polarity of the inserted earphone plug.

The information acquisition module 404 may acquire pre-stored first polarity information before the insertion of the earphones or in response to the insertion of the earphones. The first polarity information may be polarity information of the earphones predicted by the electronic device to preset a sound path before the actual polarity of the inserted earphones is identified. According to an embodiment, the information acquisition module 404 may acquire as the first polarity information the mostly recently used earphone polarity information among the stored earphone polarity information. According to another embodiment, the information acquisition module 404 may acquire as the first polarity information the earphone polarity information having a number of uses larger than or equal to a threshold value among the stored earphone polarity information. According to another embodiment, the information acquisition module 404 may acquire as the first polarity information the earphone polarity information having the largest number of uses among the stored earphone polarity information. According to another embodiment, the information acquisition module 404 may acquire as the first polarity information the earphone polarity information corresponding to a location of the current electronic device 101 among the stored earphone polarity information. According to yet another embodiment, the information acquisition module 404 may acquire as the first polarity information the earphone polarity information designated by the user.

According to one embodiment, the information acquisition module 404 may identify a second polarity information corresponding to the inserted earphones. According to one embodiment, the information acquisition module 404 may determine the second polarity information of the earphones from the recognition terminal that makes contact with at least one terminal of the inserted earphone plug. According to an embodiment, the information acquisition module 404 may determine whether non-microphone type earphones (for example, 3-pole type earphones) or microphone type earphones (for example, 4-pole type earphones) are inserted based on the polarity of the earphones.

The path setting module 406 may set a sound path based on the earphone polarity information. According to an embodiment, the path setting module 406 may set the sound input path and/or the sound output path based on the polarity information.

According to one embodiment, the path setting module 406 may first set the sound path based on the first polarity information. The first path may be a path corresponding to earphones (or polarity of earphones) predicted to be used. According to an embodiment, in response to the predicted polarity information corresponding to the non-microphone type earphones, the path setting module 406 may set the sound input path to a sound input device such as a microphone included in the electronic device 101 and set the sound output path to a sound output device such as a speaker of the earphones. According to another embodiment, in response to the predicted polarity information corresponding to the microphone type earphones, the path setting module 406 may set the sound input path to a sound input device such as the microphone of the earphones and set the sound output path to a sound output device such as the speaker of the earphones.

According to one embodiment, the path setting module 406 may reset the sound path based on the second polarity information. According to an embodiment, the path setting module 406 may reset the sound path from a sound path that corresponds to non-microphone type earphones into a sound path that corresponds to microphone type earphones. For example, the path setting module 406 may change the sound path to the microphone included in the electronic device 101 and the speaker of the earphones into another sound path to the microphone of the earphones and the speaker of the earphones. According to another embodiment, the path setting module 406 may reset the sound path from a sound path that corresponds to microphone type earphones into a sound path that corresponds to non-microphone type earphones. For example, the path setting module 406 may change the sound path to the microphone of the earphones and the speaker of the earphones into another sound path to the microphone included in the electronic device 101 and the speaker of the earphones.

The determination module 408 may determine a condition for changing the first sound path into the second sound path. According to one embodiment, the determination module 408 may determine whether the first polarity information and the second polarity information are compatible by determining whether the compatibility between the first polarity information and the second polarity information meets a predetermined condition. For example, the determination module 408 may perform an operation of determining the compatibility by determining whether the actually inserted earphones can be operated using the sound path set based on the first and predicted polarity information.

According to one embodiment, at least one of the recognition module 402, the information acquisition module 404, the path setting module 406, and the determination module 408 of the processor 400 may be at least one software component executed by the processor 400. According to one embodiment, the processor 400 may include at last one module for performing an operation of setting the sound path based on the first polarity information and resetting the sound path based on the second polarity information. According to one embodiment, the electronic device 101 may perform the operations of setting the sound path based on the first polarity information and resetting the sound path based on the second polarity information through a separate module (for example, an audio processor electrically connected to the processor or an external amplifier) different from the processor 400.

According to one embodiment, the processor 400 may display the first polarity information on the screen (for example, the display 160) in response to the acquisition of the first polarity information.

According to one embodiment, at least one of the recognition module 402, the information acquisition module 404, the path setting module 406, and the determination module 408 of the processor 400 may be omitted. According to an embodiment, the processor 400 may include the recognition module 402 and the path setting module 406. For example, when insertion of earphones is detected by the recognition module 402, the path setting module 406 may set the sound path by using pre-stored polarity information (for example, polarity information selected by the user and polarity information of the non-microphone type earphones). According to another embodiment, the processor 400 may include the recognition module 402, the path setting module 406, and the determination module 408. For example, when the insertion of the earphones is detected by the recognition module 402, the path setting module 406 may set a first sound path by using predetermined polarity information, and the determination module 408 may determine a condition for changing the first sound path into a second path.

Figure 4B:
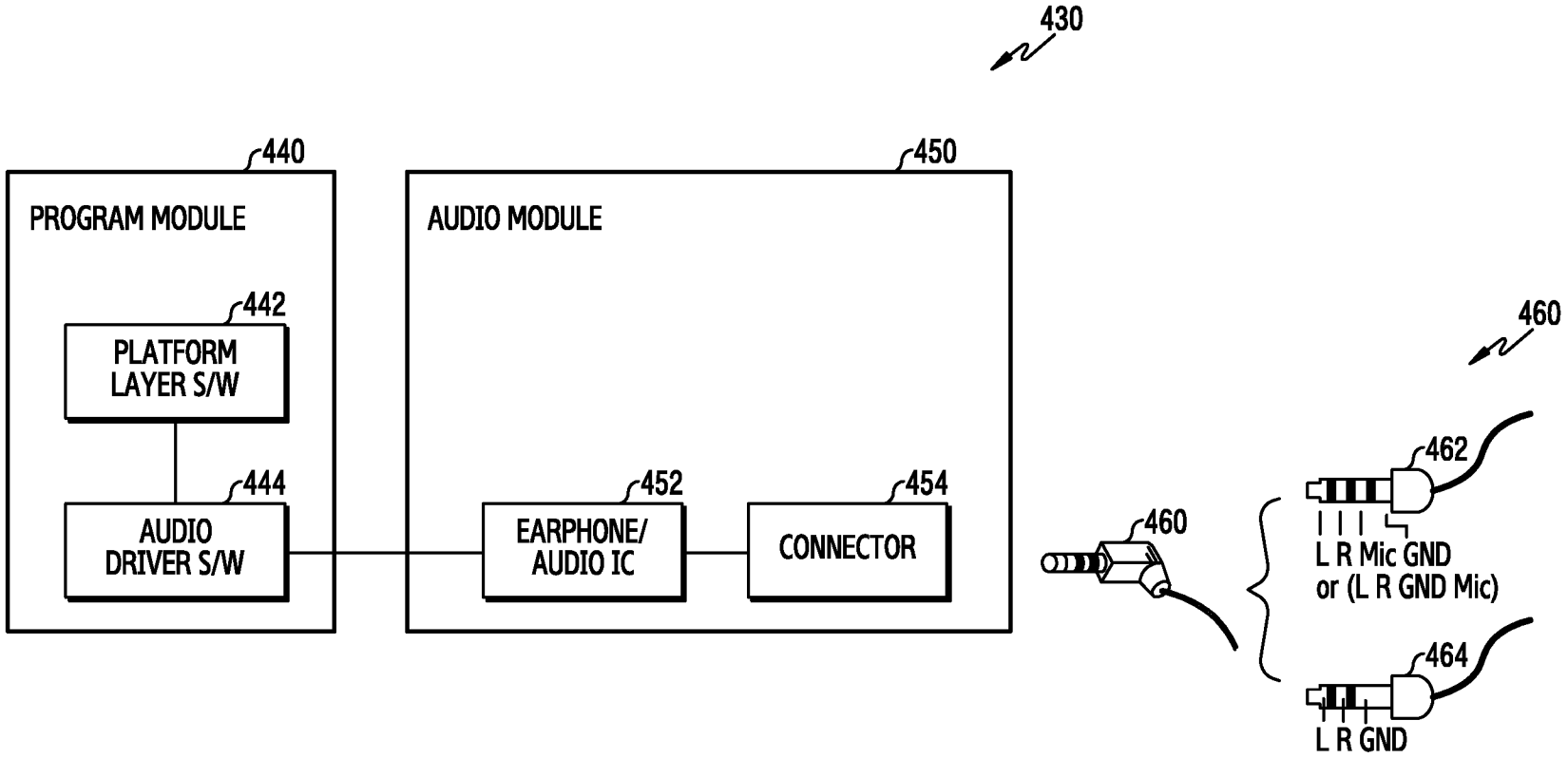
FIG. 4B illustrates a configuration of earphones of an electronic device according to one embodiment of the present disclosure.

FIG. 4B illustrates a configuration of an electronic device 430 and earphones 460 according to one embodiment of the present disclosure. According to an embodiment, the electronic device 430 may be the electronic device 101 or the electronic device 201.

According to one embodiment, the electronic device may include a program module 440 and an audio module 450. According to an embodiment, the program module 440 may include platform layer software (SW) 442 (for example, the middleware 330) and audio driver software (SW) 444 (for example, the device driver 323 or the kernel 320). According to an embodiment, the audio module 450 may include an earphone/audio Integrated Circuit (IC) 452 and a connector 454.

According to one embodiment, the audio module 450 may detect insertion of the earphones 460 (for example, 4-pole earphones 462 or 3-pole earphones 464) and set the sound path. According to one embodiment, the connector 454 may generate a recognition signal through a recognition terminal (not shown) that contacts at least one polarity of the plug of the inserted earphones 460, and the earphone/audio IC 452 may detect the insertion of the earphones 460 by receiving the recognition signal generated by the recognition terminal of the connector. The recognition terminal may be able to determine whether 4-pole earphones 462 or 3-pole earphones 464 were inserted. According to one embodiment, the audio module 450 may set the sound path based on the earphone polarity information after detecting the insertion of the earphones 460. According to an embodiment, the audio module 450 may receive polarity information from the program module 440 and set the sound path.

According to one embodiment, the program module 440 may set the sound path before or in response to the insertion of the earphones 460. According to an embodiment, the audio driver software 444 may acquire pre-stored polarity information and provide it to the platform layer software 442 before or in response to the insertion of the earphones 460, and the platform layer software 442 may provide a control command to the audio module 450 through the driver software 444 to set the sound path.

According to one embodiment, the program module 440 may be a software component executed by the processor (for example, the processor 400), and the audio module 450 may be a hardware component. According to an embodiment, the audio module 450 may be an element separated from the processor (for example, the processor 400). According to an embodiment, at least one element of the program module 440 may be configured as a hardware component.

According to an embodiment, elements of the program module 440 and the audio module 450 may perform operations identical or similar to at least one module among the recognition module 402, the information acquisition module 404, the path setting module 406, and the determination module 408 of the processor 400. For example, the connector 454 of the audio module 450 may perform an operation identical or similar to the recognition module 402 of the processor 400. In another example, at least one element (one of the platform layer software 442, the audio driver software 444, the earphone/audio IC 452) except for the connector 454 of the audio module 450 may perform operations identical or similar to the information acquisition module 404, the path setting module 406, and the determination module 408 of the processor 400.

An electronic device according to one embodiment of the present disclosure may include a memory and a processor electrically coupled to the memory. According to an embodiment, the processor may be configured to detect an insertion of earphones into a connector of the electronic device, to acquire a first polarity information stored in the memory, based on the first polarity information, to set a sound path for inputting or outputting a sound to or from the electronic device, to determine second polarity information corresponding to the inserted earphones, to determine whether the first polarity information is compatible with the second polarity information, and to reset the sound path based on the second polarity information when the first polarity information is not compatible with the second polarity information.

According to one embodiment, the first polarity information may correspond to polarity information stored in the memory before the insertion of the earphones is detected.

According to one embodiment, the first polarity information is at least one of a most recently used polarity information, a polarity information corresponding a number of uses greater than a threshold, a most frequently used polarity information, a polarity information corresponding to a location of the electronic device, a polarity information designated by a user, and a prioritized polarity information.

According to one embodiment, the processor may be configured to update the first polarity information stored in the electronic device based on the second polarity information.

According to one embodiment, the processor may be configured to operate the inserted earphones through the sound path set based on the first polarity information when the first polarity information is compatible with the second polarity information.

According to one embodiment, the processor may be configured to identify the earphones and to set a sound effect corresponding to the identification.

According to one embodiment, the processor may be configured to set the sound path based on second polarity information corresponding to the inserted earphones when the first polarity information is not acquired.

According to one embodiment, the processor may be configured to display the first polarity information on the screen of the electronic device in response to the acquisition of the first polarity information.

According to one embodiment, the processor may be configured to determine that the compatibility is met when the first polarity information and the second polarity information are identical to each other.

According to one embodiment, the processor may be configured to determine that the compatibility is met when the inserted earphones are compatible with the sound path set based on the first polarity information even though the first polarity information and the polarity information of the inserted earphones are not identical to each other.

An electronic device according to one embodiment may include a memory and a processor electrically coupled to the memory. According to an embodiment, the processor may be configured to detect insertion of earphones into a connector of the electronic device, to acquire a first polarity information stored in the memory, and to display the first polarity information on a screen of the electronic device.

According to one embodiment, the processor may be configured to set a sound path for inputting or outputting a sound to or from the electronic device based on the first polarity information, to determine a second polarity information corresponding to the earphones, to determine whether the first polarity information is compatible with the second polarity information, and to reset the sound path based on the second polarity information when first polarity information is not compatible with the second polarity information.

According to one embodiment, the processor may be configured to change the displayed first polarity information into the second polarity information when the first polarity information is not compatible with the second polarity information.

Figure 5A:
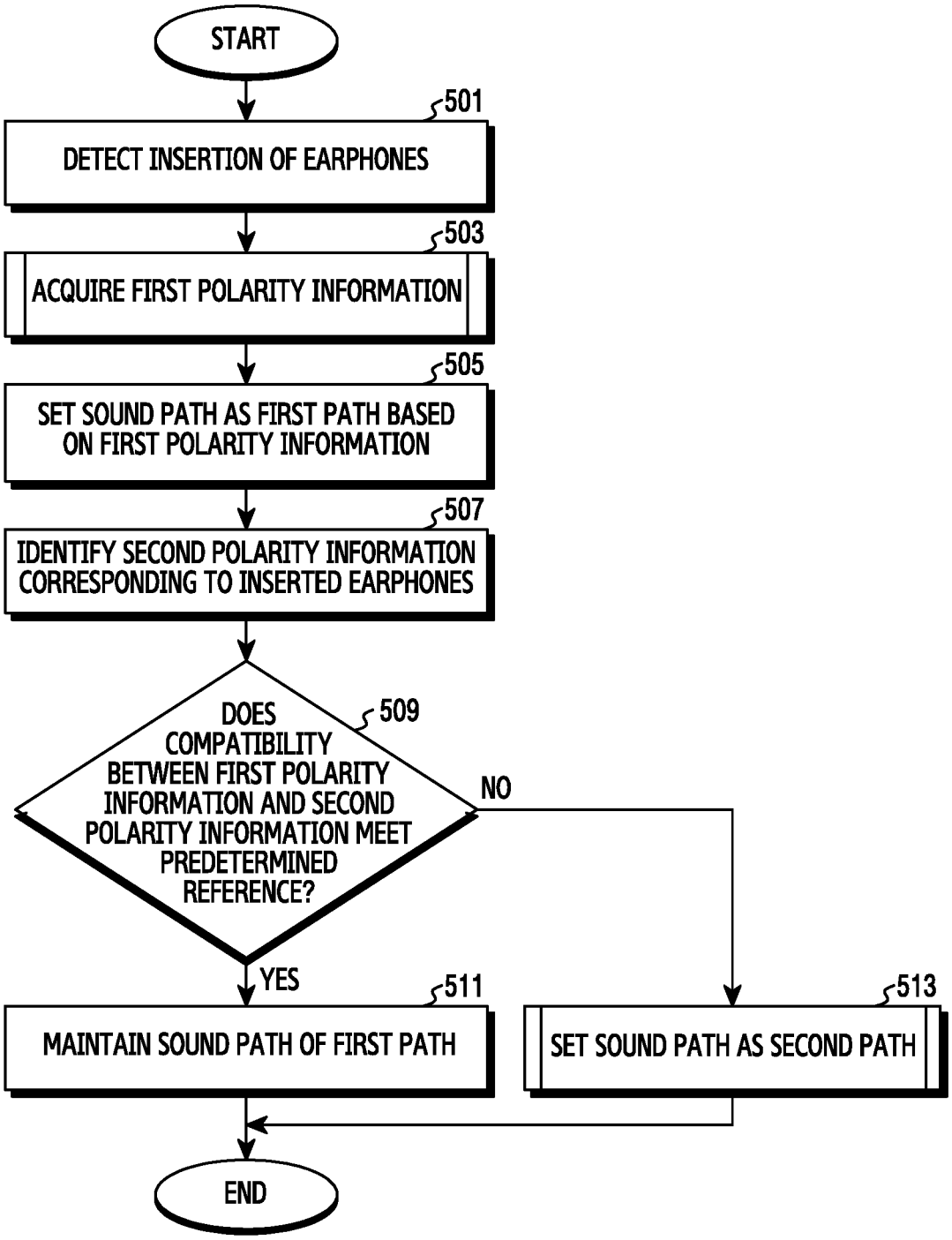
FIG. 5A is a flowchart illustrating an operation of performing an earphone recognition method of an electronic device according to one embodiment of the present disclosure.

FIG. 5A is a flowchart illustrating an operation of performing an earphone recognition method of an electronic device according to one embodiment of the present disclosure.

In operation 501, the electronic device (for example, the electronic device 101, the processor 120, the electronic device 201, the processor 400, or the audio module 450) may detect the insertion of earphones. According to one embodiment, the electronic device may detect whether the earphones are inserted based on whether a plug of the earphones of at least one polarity (for example, 3-pole earphone plug or 4-pole earphone plug) is inserted into a connector (for example, earphone plug socket or connector 454).

According to one embodiment, the electronic device may include at least one recognition terminal for detecting the earphone insertion. According to an embodiment, the recognition terminal may be adapted to contact at least one polarity of the inserted earphone plug. For example, the recognition terminal may be provided at the connector 454 into which the earphone plug is inserted. According to an embodiment, the earphone insertion may be detected by at least one processor (for example, application processor or audio processor) of the electronic device.

In operation 503, the electronic device (for example, the electronic device 101, the processor 120, the electronic device 201, the processor 400, or the program module 440) may acquire first polarity information. According to an embodiment, the first polarity information may be information used to preset the sound path before the polarity of the actually inserted earphones is identified and may be stored in the electronic device. As it takes a predetermined time to identify the polarity of the actually inserted earphones, the electronic device may predict the polarity of the earphones used by the user based on the first polarity information. Alternatively, according to another embodiment, the electronic device may acquire the first polarity information before detecting the insertion of the earphones.

For example, the first polarity information may be associated with a use history. The electronic device may predict earphones which the user desires to use based on the recently used earphone polarity information among the stored earphone polarity information. Accordingly, the electronic device may acquire the most recently used earphone polarity information among the pre-stored earphone polarity information as the first polarity information.

In another example, the first polarity information may be associated with a number of uses. The electronic device may identify the number of uses for a plurality of polarity information stored in memory and predict the earphones which the user desires to use based on the number of uses. For example, the electronic device may acquire, as the first polarity information, the earphone polarity information having a number of uses larger than or equal to a threshold value among the stored earphone polarity information. In another example, the electronic device may acquire, as the first polarity information, polarity information of the earphones having the largest number of uses among the stored earphone polarity information.

In another example, the first polarity information may be associated with location information. The electronic device may predict earphones which the user desires to use based on earphone polarity information associated with a history of being used at a location. For example, the electronic device may acquire, as the first polarity information, polarity information of the earphones corresponding to the current location of the electronic device among the stored earphone polarity information.

In operation 505, the electronic device (for example, the electronic device 101, the processor 120, the electronic device 201, the processor 400, and the audio module 450) may set the sound path as the first path based on the first polarity information. According to an embodiment, the electronic device may set the sound path corresponding to the earphones predicted to be used by the user based on the first polarity information. For example, the electronic device may set a sound input path, a sound output path, or a sound input/output path as the first path.

For example, in response to the acquisition of the first polarity information corresponding to the non-microphone type earphones (for example, 3-pole type earphones), the electronic device may set the first sound path to include an input path to the microphone included in the electronic device and set the output path to the speaker of the earphones. In another example, in response to the acquisition of the first polarity information corresponding to the microphone type earphones (for example, 4-pole type earphones), the electronic device may set the first sound path to include an input path to the microphone of the earphones and set the output path to the speaker of the earphones.

According to one embodiment, the first path may be set by at least one program module. For example, the first path may be set by providing the first polarity information to at least one module (for example, the resource manager 334) included in the middleware (for example, the middleware 330) by at least one module (for example, the device driver 323) included in the kernel (for example, the kernel 320).

In operation 507, the electronic device (for example, the electronic device 101, the processor 120, the electronic device 201, the processor 400, or the program module 440) may identify second polarity information corresponding to the inserted earphones. The second polarity information may be polarity information of the actually inserted earphone plug. According to one embodiment, as explained above, the electronic device may determine the polarity of the earphones inserted through a recognition terminal that contacts at least one terminal of the inserted earphone plug. According to an embodiment, the electronic device may determine whether non-microphone type earphones or microphone type earphones are inserted based on the polarity of the earphones. For example, the non-microphone type earphones may be 3-pole type earphones including an earphone ground terminal, an earphone left terminal, and an earphone right terminal, such as earphones 464 shown in FIG. 4B. And microphone type earphones may be 4-pole type earphones including an earphone microphone terminal, an earphone ground terminal, an earphone left terminal, and an earphone right terminal, such as earphones 462 shown in FIG. 4B. However, embodiments of the present disclosure are not limited thereto. For example, the polarity of the non-microphone type may be not the 3-pole and the polarity of the microphone type may not be the 4-pole.

According to one embodiment, the electronic device may acquire additional information of the inserted earphones. For example, the electronic device may identify impedance information for controlling a sound output size, information for determining abnormal earphone recognition, and humidity information for blocking an earphone output.

In operation 509, the electronic device (for example, the electronic device 101, the processor 120, the electronic device 201, the processor 400, or the audio module 450) may identify whether compatibility between the first polarity information and the second polarity information meets a predetermined condition. According to one embodiment, the electronic device may perform an operation of determining the compatibility by determining whether the actually inserted earphones can be operated using the first path. According to an embodiment, compatibility may be determined according to Table 1. However, embodiments of the present disclosure are not limited to table 1.

TABLE 1

| First polarity information | Second polarity information | Whether compatibility is met | Input Result |
|---|---|---|---|
| 3-pole | 3-pole | met | Electronic device microphone is used |
| 4-pole | 4-pole | met | Earphone microphone is used |
| 3-pole | 4-pole | met | Electronic device microphone is used |

According to an embodiment, when the first polarity information and the second polarity information are the same, it may be determined that the predetermined reference is met and that the first and second polarity information are compatible. According to another embodiment, when the actually inserted earphones can be operated through the sound input path set based on the first polarity information, even though the first polarity information and the second polarity information are not the same, the electronic device may determine that the predetermined reference is met. For example, when the electronic device is designated to receive input sound from the microphone of the electronic device instead of the microphone of the earphones, even though microphone type earphones are inserted, the electronic device may determine that the predetermined reference is met and use the sound path set based on the first polarity information. According to another embodiment, when the actually inserted earphones can be operated through the sound output path set based on the first polarity information, even though the first polarity information and the second polarity information are not the same, the electronic device may determine that the predetermined reference is met.

According to one embodiment, incompatibility may be determined according to Table 2. However, embodiments of the present disclosure are not limited to table 2.

TABLE 2

| First polarity information | Second polarity information | Whether compatibility is met |
|---|---|---|
| 3-pole | 4-pole | Not met |
| 4-pole | 3-pole | Not met |

According to an embodiment, when the first polarity information and the second polarity information are not the same, the electronic device may determine that the compatibility does not meet the predetermined reference and that therefore the first and second polarity information are not compatible.

In response to the determination that the compatibility meets the predetermined reference in operation 509, the electronic device (for example, the electronic device 101, the processor 120, the electronic device 201, the processor 400, or the audio module 450) may maintain the sound path of the first path, i.e. the sound path set based on the first polarity information, in operation 511. According to various embodiments, the electronic device may operate the inserted earphones by using the sound path of the first path.

In response to the determination that the compatibility does not meet the predetermined reference in operation 509, the electronic device (for example, the electronic device 101, the processor 120, the electronic device 201, the processor 400, or the audio module 450) may set the sound path as a second path in operation 513, i.e. reset the sound path based on the second polarity information of the actually inserted earphones. According to an embodiment, the electronic device may change the sound path set based on the first polarity information corresponding to non-microphone type earphones into the sound path corresponding to microphone type earphones. For example, the electronic device may change the sound path using the microphone included in the electronic device and the speaker of the earphones into another sound path using the microphone of the earphones and the speaker of the earphones. According to another embodiment, the electronic device may change the sound path set based on the first polarity information corresponding to microphone type earphones into the sound path corresponding to non-microphone type earphones. For example, the electronic device may change the sound path using the microphone of the earphones and the speaker of the earphones into another sound path using the microphone included in the electronic device and the speaker of the earphones. According to an embodiment, the second path may be set by at least one program module. For example, the second path may be set by providing the second polarity information to at least one module (for example, the resource manager 344) included in the middleware (for example, the middleware 330) by at least one module (for example, the device driver 323) included in the kernel (for example, the kernel 320).

According to one embodiment, the electronic device may operate the inserted earphones by using the sound path of the second path, i.e. the sound path set based on the second polarity information.

An electronic device according to one embodiment of the present disclosure presets the sound path based on the earphone polarity information used before the earphone insertion is detected, but such an operation may be performed according to the detection of other external devices. For example, an operation of detecting a device insertion according to one embodiment may be an operation of detecting insertion of, for example, speaker or microphone, that includes a plug having at least one polarity.

Figure 5B:
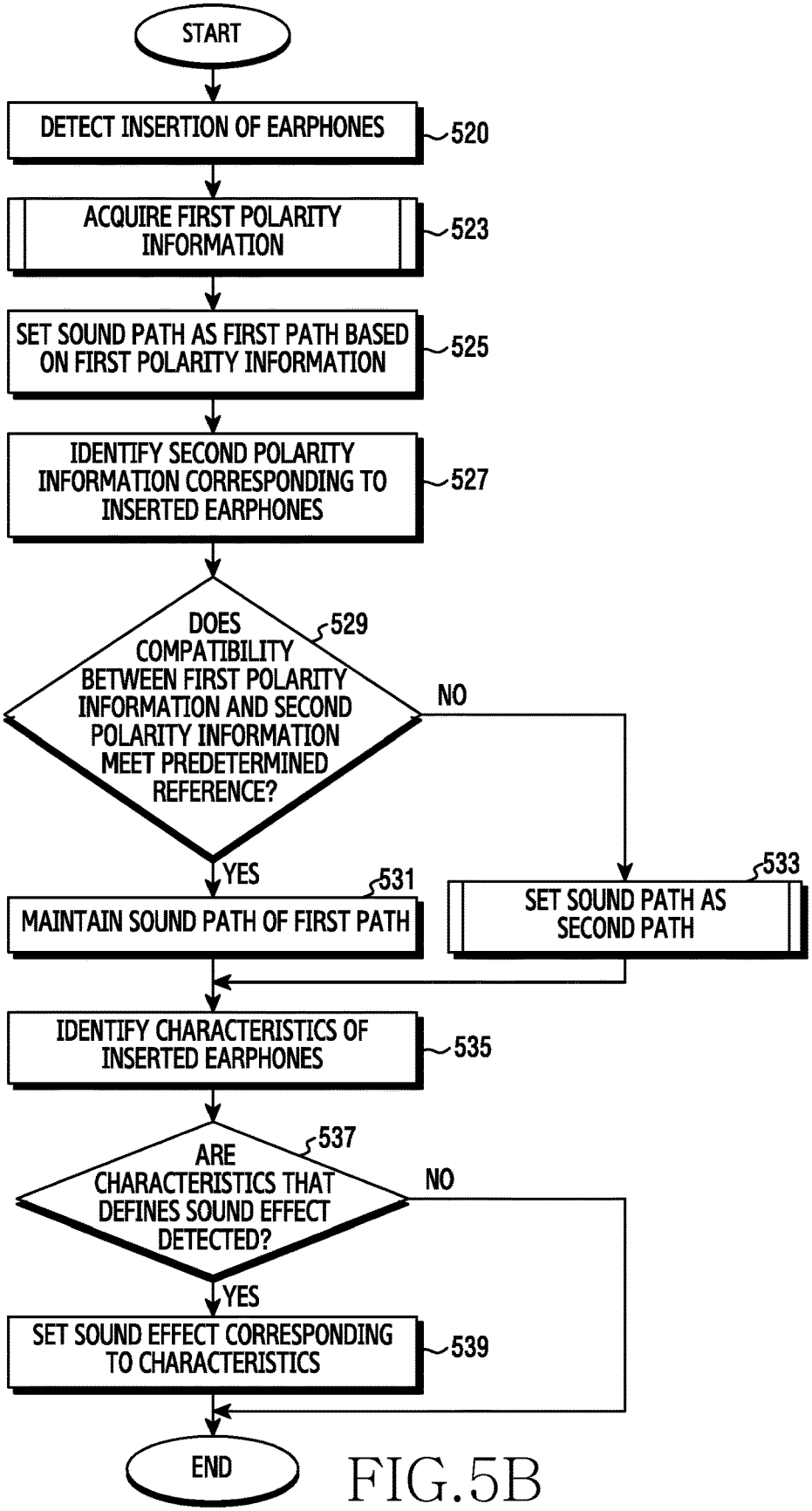
FIG. 5B is a flowchart illustrating another operation of performing the earphone recognition method of the electronic device according to one embodiment of the present disclosure.

FIG. 5B is a flowchart illustrating an operation of performing an earphone recognition method of the electronic device according to one embodiment of the present disclosure. In FIG. 5B, a description identical or similar to the part of FIG. 5A may be omitted.

In operation 520, the electronic device (for example, the electronic device 101, the processor 120, the electronic device 201, the processor 400, or the audio module 450) may detect insertion of earphones.

In operation 523, the electronic device (for example, the electronic device 101, the processor 120, the electronic device 201, the processor 400, or the program module 440) may acquire first polarity information. According to an embodiment, the first polarity information may be information used to preset the sound path before the polarity of the actually inserted earphones is identified and may be stored in the electronic device.

In operation 525, the electronic device (for example, the electronic device 101, the processor 120, the electronic device 201, the processor 400, and the audio module 450) may set the sound path as the first path based on the first polarity information. According to an embodiment, the electronic device may set the sound path corresponding to the earphones predicted to be used by the user based on the first polarity information. For example, the electronic device may set a sound input path, a sound output path, or a sound input/output path as the first path.

In operation 527, the electronic device (for example, the electronic device 101, the processor 120, the electronic device 201, the processor 400, or the program module 440) may identify second polarity information corresponding to the inserted earphones. The second polarity information may be polarity information of the actually inserted earphone plug.

In operation 529, the electronic device (for example, the electronic device 101, the processor 120, the electronic device 201, the processor 400, or the audio module 450) may identify whether compatibility between the first polarity information and the second polarity information meets a predetermined condition. According to one embodiment, the electronic device may perform an operation of identifying the compatibility by determining whether the actually inserted earphones can be operated using the first path set based on the first polarity information.

In response to the determination that the compatibility meets the predetermined reference in operation 529, the electronic device (for example, the electronic device 101, the processor 120, the electronic device 201, the processor 400, or the audio module 450) may maintain the sound path of the first path set based on the first polarity information in operation 531. According to one embodiment, the electronic device may operate the inserted earphones by using the sound path of the first path.

In response to the determination that the compatibility does not meet the predetermined reference in operation 529, the electronic device (for example, the electronic device 101, the processor 120, the electronic device 201, the processor 400, or the audio module 450) may set the sound path as a second path in operation 533, i.e., the sound path set based on the second polarity information.

In operation 535, the electronic device (for electronic device 201, the processor 400, or the audio module 450) may identify characteristics of the inserted earphones. According to an embodiment, the characteristics of the earphones may be an earphone identifier. According to one embodiment, when the earphones are inserted, the electronic device may measure a resistance value of the inserted earphones and identify the earphones based on a range of the measured resistance value. According to another embodiment, the electronic device may receive identification information from the earphones. For example, the earphones may include a processor for controlling an overall operation of the earphones, and the electronic device may identify the earphones based on the identification information provided by the processor of the earphones. According to one embodiment, the earphone identifier may be an identifier that defines a sound effect preferred by the earphones. For example, the electronic device may identify the sound effect preferred by the earphones by checking the characteristics of the earphones.

In operation 537, the electronic device (for example, the electronic device 201, the processor 400, or the audio module 450) may determine whether the characteristics of the earphones that define the sound effect are detected. According to one embodiment, the electronic device may define and store a sound effect (for example, a high sound field effect, a low sound field effect, and/or equalizer information) corresponding to the earphone identifier. According to an embodiment, the electronic device may identify whether there is a sound effect related to the characteristics of the inserted earphones in a plurality of stored sound effects.

When the earphone characteristics that define the sound effect is detected in operation 537, the electronic device (for example, the electronic device 201, the processor 400, or the audio module 450) may set the sound effect corresponding to the characteristics in operation 539.

When the earphone characteristics that define the sound effect are not detected in operation 537, the electronic device (for example, the electronic device 201, the processor 400, or the audio module 450) may end the algorithm.

According to one embodiment, at least one of operations 520 to 539 may be omitted. For example, after setting the sound path as the first path in operation 525, the electronic device may identify the characteristics of the inserted earphones in operation 535.

According to one embodiment, the processor module (400 (for example, the audio driver S/W 444) may receive the polarity information of the inserted earphones and the earphone characteristics from the audio module 450 at the same time or successively. For example, operation 527 of identifying the second polarity information corresponding to the inserted earphones and operation 535 of identifying characteristics of the inserted earphones may be performed at the same time or successively. The following operations (for example, operations 529, 531, and 533 corresponding to operation 527 and operations 537 and 539 corresponding to operation 535) of the two identification operations may be also performed at the same time or successively.

Figure 6:
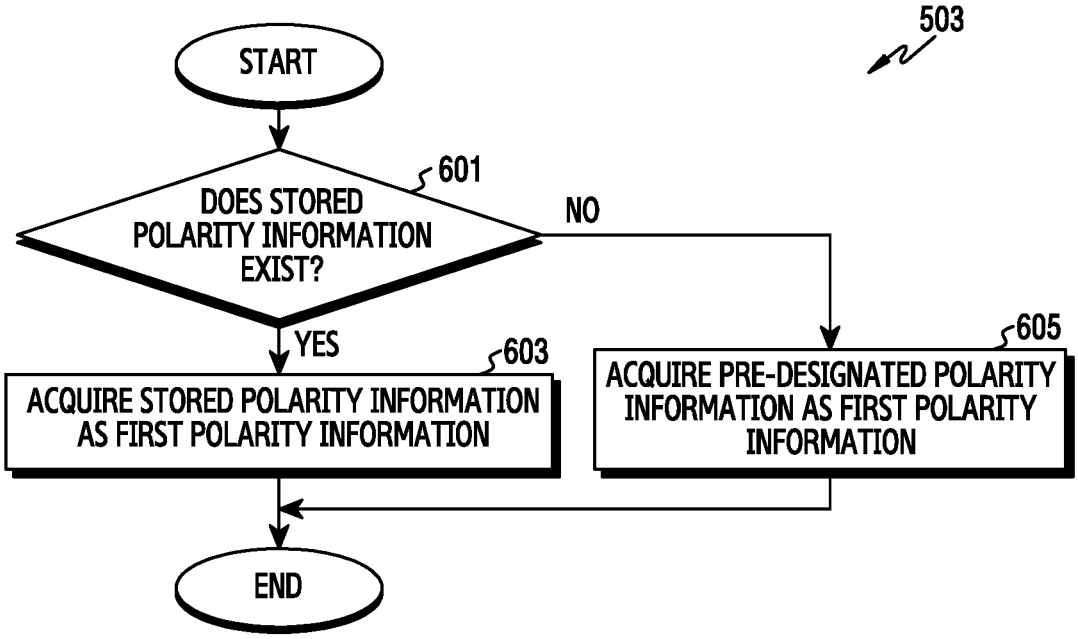
FIG. 6 is a flowchart illustrating an operation of performing a first polarity information acquisition method of the electronic device according to one embodiment of the present disclosure.

FIG. 6 is a flowchart illustrating an operation of performing a first polarity information acquisition method of the electronic device according to one embodiment of the present disclosure.

According to one embodiment, the operation of performing the first polarity information acquisition method may be a detailed operation of operation 503 of FIG. 5.

According to one embodiment, the electronic device may store earphone polarity information of at least one inserted earphones in response to the earphone insertion. However, when there is no history of the connection of the earphones with the electronic device, earphone polarity information may not exist.

In operation 601, the electronic device (for example, the electronic device 101, the processor 120, the electronic device 201, the processor 400, or the program module 440) may determine whether the stored earphone polarity information exists.

In response to the determination of the existence of the stored earphone polarity information in operation 601, the electronic device (for example, the electronic device 101, the processor 120, the electronic device 201, the processor 400, or the program module 440) may acquire the stored earphone polarity information as first polarity information in operation 603. For example, the electronic device may acquire the polarity information of the earphones previously inserted into the electronic device as the first polarity information.

In response to the determination of the non-existence of the stored earphone polarity information in operation 601, the electronic device (for example, the electronic device 101, the processor 120, the electronic device 201, the processor 400, or the program module 440) may acquire pre-designated polarity information as the first polarity information. According to one embodiment, the pre-designated polarity information may be information associated with a sound path which can operate both the non-microphone type earphones and the microphone type earphones. For example, the pre-designated polarity information may be polarity information of the non-microphone type, and the electronic device may process the sound to be input through the microphone of the electronic device even through earphones of the microphone type are inserted.

According to one embodiment, the electronic device may set the sound path as the first path based on the acquired first polarity information. According to an embodiment, the electronic device may perform an operation associated with operation 505 of FIG. 5.

According to one embodiment, if the first polarity information is not acquired, the electronic device may process the inserted earphones to operate after the sound path is set based on the pre-designated polarity information.

Figure 7:
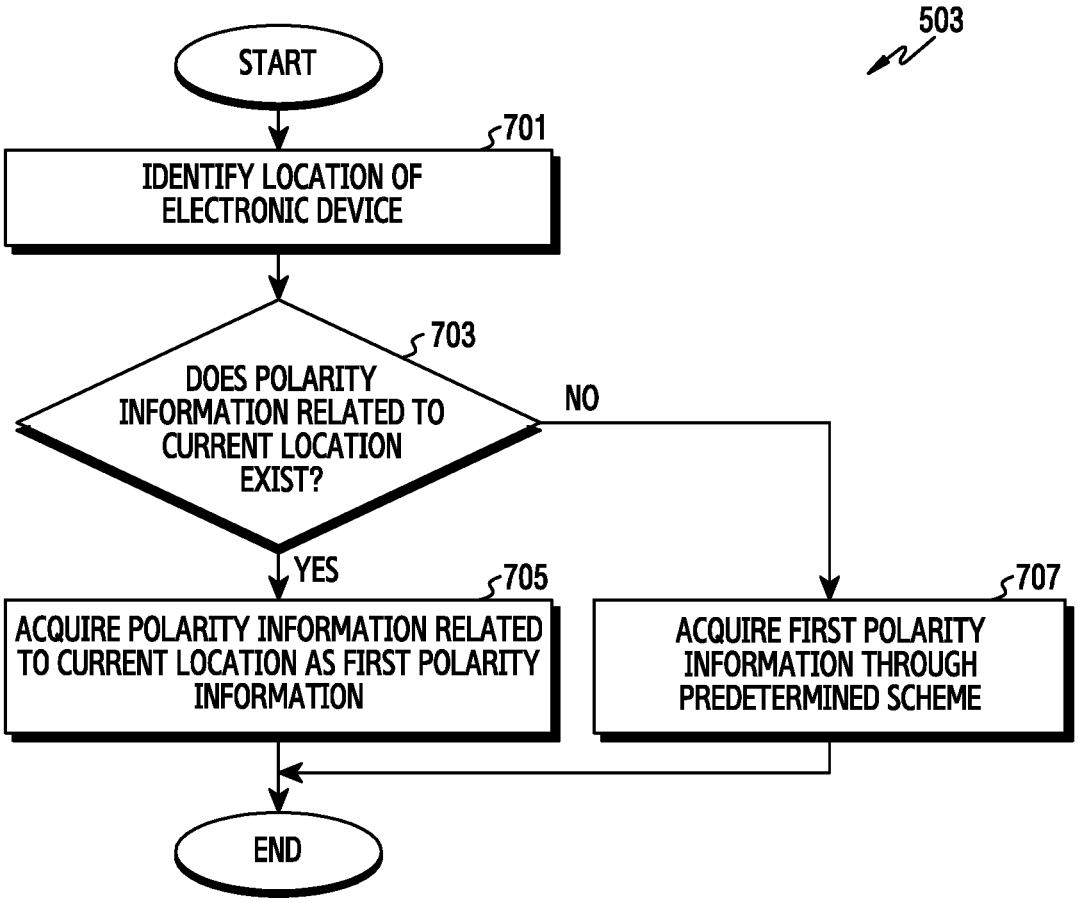
FIG. 7 is a flowchart illustrating another operation of performing the first polarity information acquisition method of the electronic device according to one embodiment of the present disclosure.

FIG. 7 is a flowchart illustrating another operation of performing the first polarity information acquisition method of the electronic device according to one embodiment of the present disclosure.

According to one embodiment, the operation of performing the first polarity information acquisition method may be a detailed operation of operation 503 of FIG. 5.

According to one embodiment, the electronic device may store earphone polarity information of the inserted earphones and information on the location where the earphones are inserted in response to the earphone insertion.

The electronic device (for example, the electronic device 101, the processor 120, the electronic device 201, the processor 400, or the program module 440) may identify the location of the electronic device in operation 701. According to an embodiment, the location of the electronic device may be associated with an area where the electronic device is currently located, and the electronic device may identify the location information in response to the detection of the earphone insertion. For example, the electronic device may identify the location of the electronic device by activating a positioning function (for example, GPS function). According to another embodiment, the location of the electronic device may be associated with entrance into a predetermined area (for example, a geo-fenced area of interest). For example, the electronic device may identify the location of the electronic device based on beacon information received through a short-range communication scheme, Bluetooth Low Energy (BLE), Bluetooth, Near Field Communication (NFC), and/or Wi-Fi. According to one embodiment, the entrance into the predetermined area may be associated with getting on a predetermined means of transportation (for example, a business vehicle or an owner-driven car).

In operation 703, the electronic device (for example, the electronic device 101, the processor 120, the electronic device 201, the processor 400, or the program module 440) may determine whether polarity information related to the current location exists in the stored polarity information.

In response to the determination of the existence of the earphone polarity information related to the current location in operation 703, the electronic device (for example, the electronic device 101, the processor 120, the electronic device 201, the processor 400, or the program module 440) may acquire the earphone polarity information related to the current location as first polarity information in operation 705.

In response to the determination of the non-existence of the earphone polarity information related to the current location in operation 703, the electronic device (for example, the electronic device 101, the processor 120, the electronic device 201, the processor 400, or the program module 440) may acquire the first polarity information through a predetermined scheme in operation 707. For example, the electronic device may acquire the first polarity information by performing the operation described in FIG. 6. In another example, the electronic device may acquire the first polarity information by performing an operation described in FIG. 8 below.

According to one embodiment, the electronic device may set the sound path as the first path based on the acquired first polarity information, for example according to operation 505 of FIG. 5.

Figure 8:
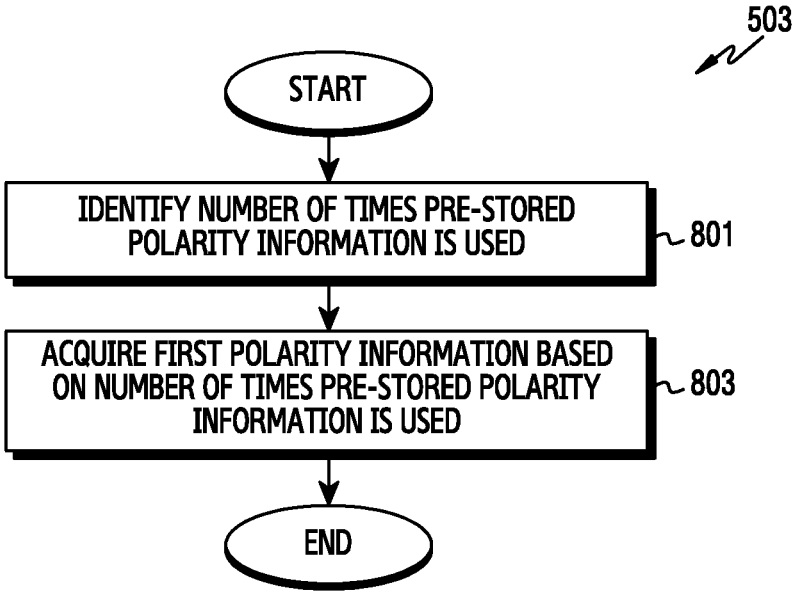
FIG. 8 is a flowchart illustrating another operation of performing the first polarity information acquisition method of the electronic device according to one embodiment of the present disclosure.

FIG. 8 is a flowchart illustrating another operation of performing the first polarity information acquisition method of the electronic device according to one embodiment of the present disclosure.

According to one embodiment, the operation of performing the first polarity information acquisition method may be a detailed operation of operation 503 of FIG. 5.

According to one embodiment, the electronic device may store polarity information in a connection history of the inserted earphones. According to an embodiment, the electronic device may match and manage each of the stored polarity information and store corresponding number of uses for each stored polarity information. For example, the electronic device may store polarity information and a number of insertions corresponding to a pair of non-microphone type earphones and polarity information and a number of insertions corresponding to a pair of microphone type earphones.

In operation 801, the electronic device (for example, the electronic device 101, the processor 120, the electronic device 201, the processor 400, or the program module 440) may identify a number of times the stored polarity information is used. For example, in response to the detection of the earphone insertion, electronic device (for example, the electronic device 101, the processor 120, the electronic device 201, the processor 400, or the program module 440) may identify a number of times each of the stored polarity information is used.

In operation 803, the electronic device (for example, the electronic device 101, the processor 120, the electronic device 201, the processor 400, or the program module 440) may acquire first polarity information based on the number of uses.

According to one embodiment, the electronic device may acquire the first polarity information based on a predetermined condition. According to an embodiment, the predetermined condition may be one of a maximum number of uses, a number of uses larger than or equal to a threshold value, a priority of the polarity information, and/or a combination thereof.

For example, the electronic device may acquire, as the first polarity information, polarity information which has been most frequently used among the stored polarity information.

In another example, the electronic device may acquire, as the first polarity information, polarity information which has a use number greater than or equal to a predetermined threshold value (for example, three times) among the stored polarity information.

In another example, when there are a plurality of polarity information which have a use number greater than or equal to a predetermined threshold value, the electronic device may select polarity information to be used as the first polarity information based on a predetermined condition. For example, the electronic device may acquire, as the first polarity information, polarity information which has the highest use number, or polarity information associated with a priority.

Figure 9:
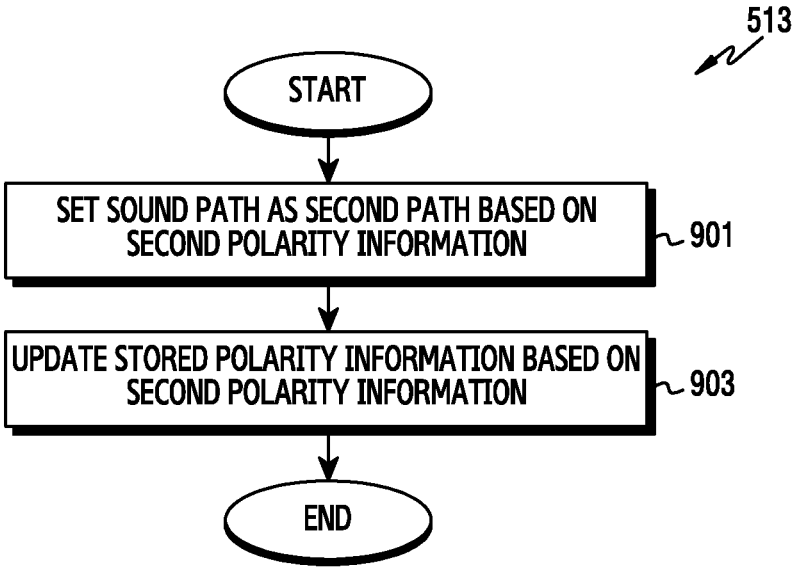
FIG. 9 is a flowchart illustrating an operation of performing a method of setting a sound path as a second path by the electronic device according to one embodiment of the present disclosure.

FIG. 9 is a flowchart illustrating an operation of performing a method of setting a sound path as a second path by the electronic device according to one embodiment of the present disclosure.

According to one embodiment, the operation of performing the method of setting the sound path as the second path may be a detailed operation of operation 513 of FIG. 5.

In operation 901, the electronic device (for example, the electronic device 101, the processor 120, the electronic device 201, the processor 400, or the program module 440) may set the sound path as the second path based on second polarity information. For example, in response to the determination that compatibility between the first polarity information and the second polarity information does not meet a predetermined condition, i.e. the first and second polarity information are not compatible, the electronic device may set or change the sound path into the second path.

In operation 903, the electronic device (for example, the electronic device 101, the processor 120, the electronic device 201, the processor 400, or the program module 440) may update the stored earphone polarity information based on the second polarity information. According to an embodiment, the electronic device may update at least the number of times the second polarity information is used and/or the location information of where the second polarity information is used.

The electronic device according to one embodiment may end the algorithm after storing the earphone polarity information in the memory.

Figure 10:
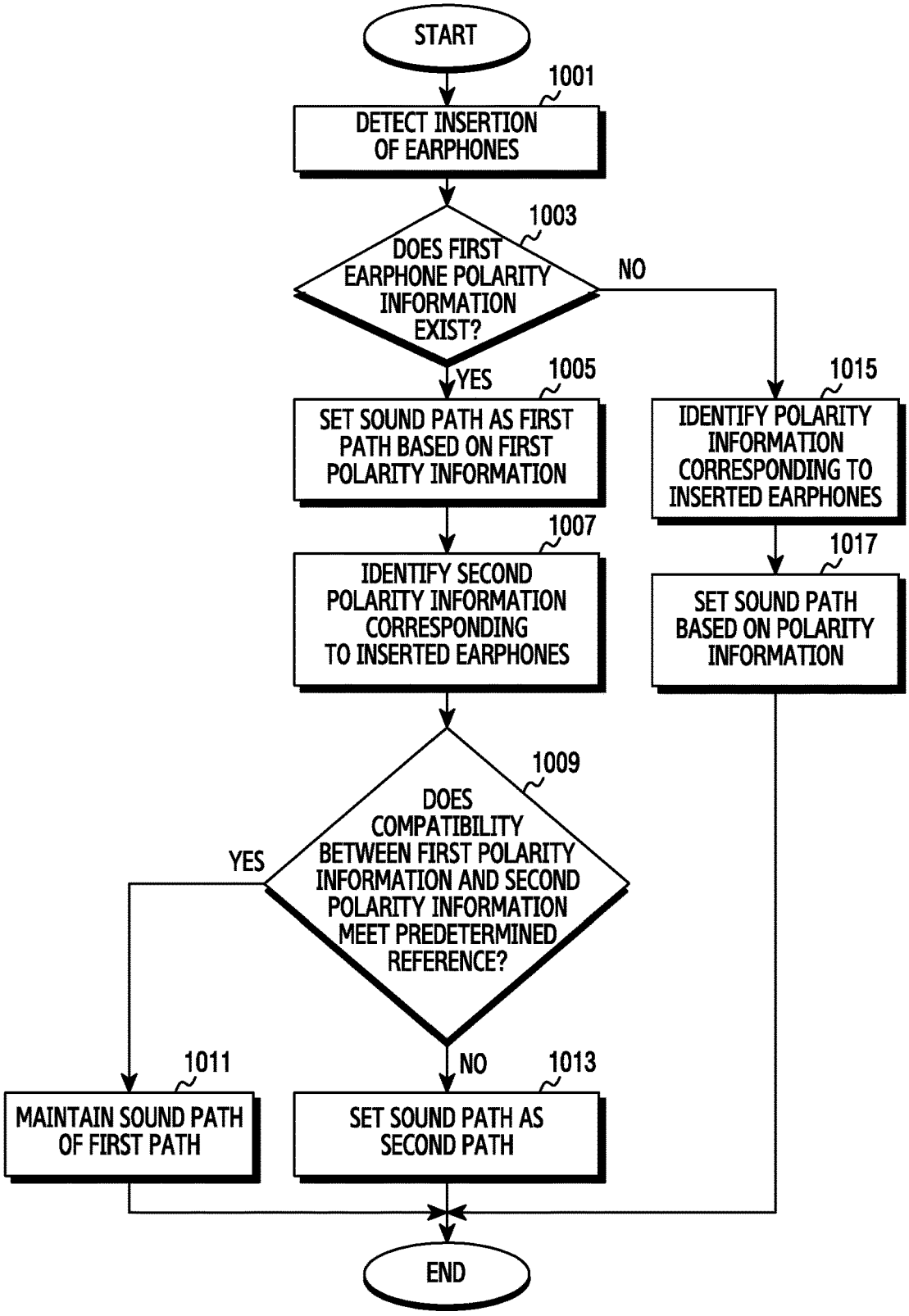
FIG. 10 is a flowchart illustrating another operation of the earphone recognition method of the electronic device according to one embodiment of the present disclosure.

FIG. 10 is a flowchart illustrating another operation of the earphone recognition method of the electronic device according to one embodiment of the present disclosure. In FIG. 10, a description identical or similar to FIG. 5 may be omitted.

In operation 1001, the electronic device (for example, the electronic device 101, the processor 120, the electronic device 201, the processor 400, or the audio module 450) may detect insertion of earphones. According to one embodiment, the electronic device may detect whether the earphones are inserted based on whether an earphone plug of at least one polarity (for example, 3-pole earphone plug or 4-pole earphone plug) from a pair of earphones is inserted into a connector (for example, earphone plug socket of the electronic device). For example, the electronic device may perform an operation corresponding to operation 501 of FIG. 5.

In operation 1003, the electronic device (for example, the electronic device 101, the processor 120, the electronic device 201, the processor 400, or the program module 440) may identify whether first polarity information exists. According to an embodiment, the first polarity information may be earphone polarity information randomly stored when the electronic device is manufactured, earphone polarity information used before the earphone insertion is detected, earphone polarity information which has a use number greater than or equal to a predetermined threshold value, earphone polarity information which has been most frequently used among stored earphone polarity information, and/or earphone polarity information having a history of use at the current location of the electronic device. For example, the electronic device may perform an operation corresponding to operation 503 of FIG. 5.

In response to the identification of the existence of the first polarity information in operation 1003, the electronic device (for example, the electronic device 101, the processor 120, the electronic device 201, the processor 400, or the audio module 450) may set the sound path as the first path based on the first polarity information in operation 1005. According to an embodiment, the electronic device may set a path corresponding to earphones predicted to be used by the user based on the first polarity information. For example, the electronic device may perform an operation corresponding to operation 505 of FIG. 5.

In operation 1007, the electronic device (for example, the electronic device 101, the processor 120, the electronic device 201, the processor 400, or the program module 440) may identify second polarity information corresponding to the inserted earphones. The second polarity information may be polarity information of the actually inserted earphone plug. For example, the electronic device may perform an operation corresponding to operation 507 of FIG. 5.

In operation 1009, the electronic device (for example, the electronic device 101, the processor 120, the electronic device 201, the processor 400, or the audio module 450) may identify whether compatibility between the first polarity information and the second polarity information meets a predetermined condition, i.e. determine whether the first and second polarity information are compatible. According to one embodiment, the electronic device may perform an operation of identifying the compatibility by determining whether the actually inserted earphones can be operated using the first path. For example, the electronic device may perform an operation corresponding to operation 509 of FIG. 5.

In response to the determination that the compatibility meets the predetermined reference in operation 1009, the electronic device (for example, the electronic device 101, the processor 120, the electronic device 201, the processor 400, or the audio module 450) may maintain the sound path of the first path in operation 1011. For example, the electronic device may perform an operation corresponding to operation 511 of FIG. 5.

In response to the determination that the compatibility does not meet the predetermined reference in operation 1009, the electronic device (for example, the electronic device 101, the processor 120, the electronic device 201, the processor 400, or the audio module 450) may set the sound path as a second path in operation 1013. For example, the electronic device may perform an operation corresponding to operation 511 of FIG. 5.

In response to the identification of the non-existence of the first polarity information in operation 1003, the electronic device (for example, the electronic device 101, the processor 120, the electronic device 201, the processor 400, or the audio module 450) may identify earphone polarity information corresponding to inserted earphones in operation 1015. For example, the electronic device may perform an operation corresponding to operation 1007. In operation 1017, the electronic device (for example, the electronic device 101, the processor 120, the electronic device 201, the processor 400, or the audio module 450) may set the sound path based on the identified earphone polarity information. According to an embodiment, the electronic device may set the sound path after collecting information on the polarity and characteristics of the inserted earphones. For example, where the first polarity information does not exist, the electronic device may perform an operation a standby mode until the earphone polarity information of the actually inserted earphones is identified.

Figure 11:
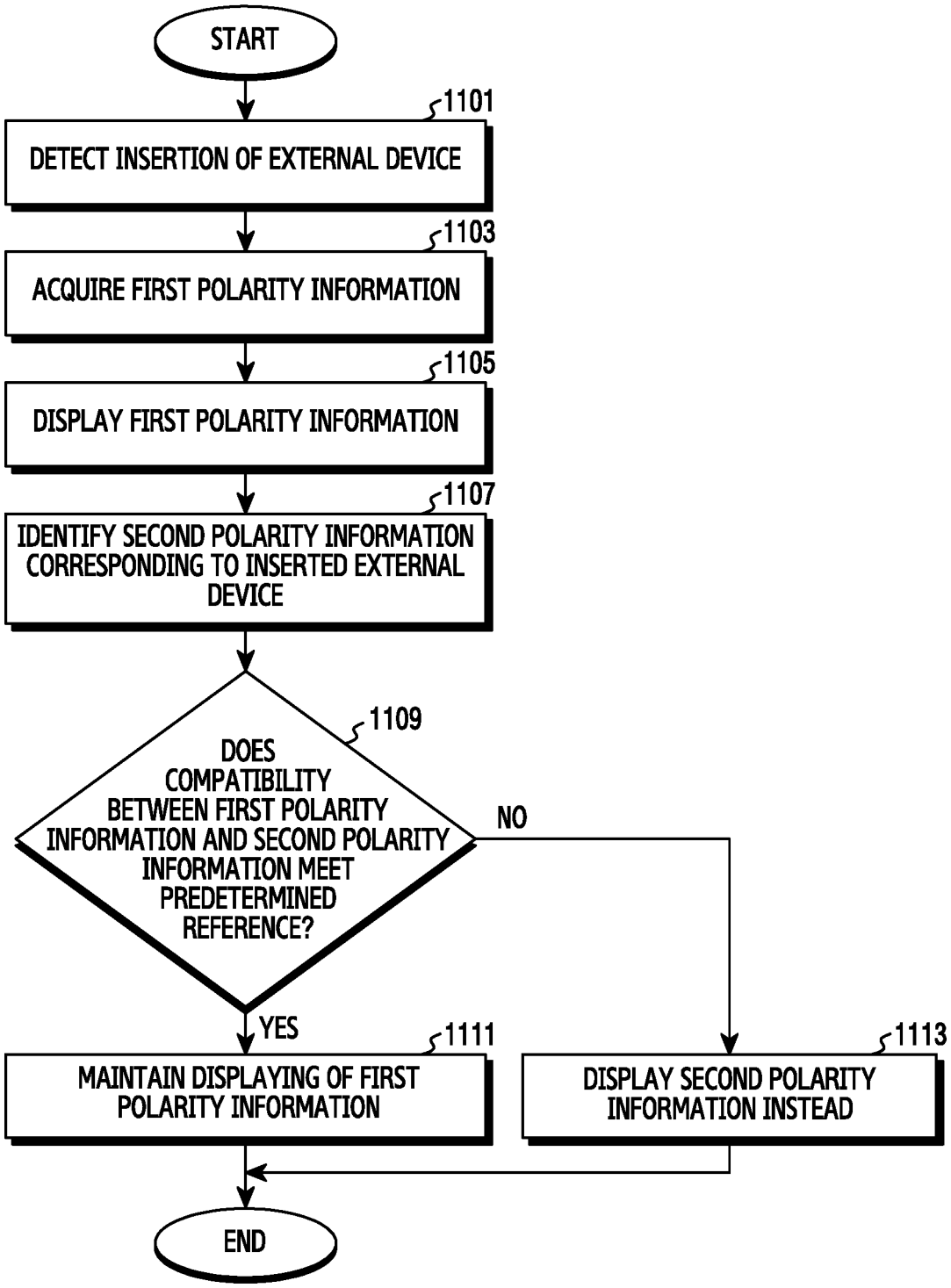
FIG. 11 is a flowchart illustrating another operation of performing the earphone recognition method of the electronic device according to one embodiment of the present disclosure.

FIG. 11 is a flowchart illustrating another operation of performing the earphone recognition method of the electronic device according to one embodiment of the present disclosure. In FIG. 11, a description identical or similar to FIG. 5 may be omitted.

In operation 1101, the electronic device (for example, the electronic device 101, the processor 120, the electronic device 201, the processor 400, or the audio module 450) may detect insertion of earphones. According to one embodiment, the electronic device may detect whether the earphones are inserted based on whether an earphone plug of at least one polarity (for example, 3-pole earphone plug or 4-pole earphone plug) from a pair of earphones is inserted into a connector (for example, earphone plug socket of the electronic device). For example, the electronic device may perform an operation corresponding to operation 501 of FIG. 5.

In operation 1103, the electronic device (for example, the electronic device 101, the processor 120, the electronic device 201, the processor 400, or the program module 440) may acquire first polarity information. According to an embodiment, the first polarity information may be earphone polarity information randomly stored when the electronic device is manufactured, earphone polarity information used before the earphone insertion is detected, earphone polarity information which has a use number greater than or equal to a predetermined threshold value, earphone polarity information which has been most frequently used among stored earphone polarity information, and/or earphone polarity information having a history of use at the current location of the electronic device. For example, the electronic device may perform an operation corresponding to operation 503 of FIG. 5.

In operation 1105, the electronic device (for example, the electronic device 101, the processor 120, the electronic device 201, the processor 400, or the audio module 450) may display the first polarity information on the screen. According to an embodiment, the first polarity information displayed on the screen may be in the form of at least one of text, image, and graphic. For example, the first polarity information may be displayed along with at least one piece of status information (for example, battery status or reception status) of the electronic device.

In operation 1107, the electronic device (for example, the electronic device 101, the processor 120, the electronic device 201, the processor 400, or the program module 440) may identify second polarity information corresponding to the inserted earphones. The second polarity information may be polarity information of the actually inserted earphone plug. For example, the electronic device may perform an operation corresponding to operation 507 of FIG. 5.

In operation 1109, the electronic device (for example, the electronic device 101, the processor 120, the electronic device 201, the processor 400, or the audio module 450) may identify whether compatibility between the first polarity information and the second polarity information meets a predetermined condition, i.e. whether the first and second polarity information are compatible. According to one embodiment, the electronic device may perform an operation of identifying the compatibility by determining whether the actually inserted earphones can be operated using the first path. For example, the electronic device may perform an operation corresponding to operation 509 of FIG. 5.

In response to the determination that the compatibility meets the predetermined condition in operation 1109, the electronic device (for example, the electronic device 101, the processor 120, the electronic device 201, the processor 400, or the audio module 450) may maintain the displaying of the first polarity information in operation 1111.

In response to the determination that the compatibility does not meet the predetermined condition in operation 1109, the electronic device (for example, the electronic device 101, the processor 120, the electronic device 201, the processor 400, or the audio module 450) may display second polarity information instead of the already displayed first polarity information in operation 1113.

Figure 12:
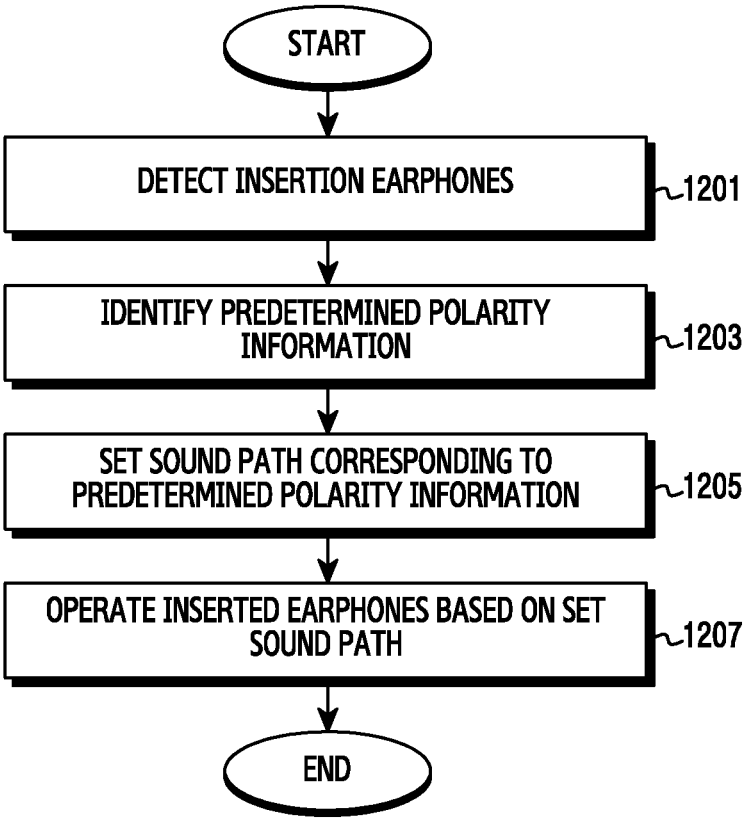
FIG. 12 is a flowchart illustrating another operation of performing the earphone recognition method of the electronic device according to one embodiment of the present disclosure.

FIG. 12 is a flowchart illustrating another operation of performing the earphone recognition method of the electronic device according to one embodiment of the present disclosure. In FIG. 12, a description identical or similar to FIG. 5 may be omitted.

In operation 1201, the electronic device (for example, the electronic device 101, the processor 120, the electronic device 201, the processor 400, or the audio module 450) may detect insertion of earphones. According to one embodiment, the electronic device may detect whether the earphones are inserted based on whether an earphone plug of at least one polarity (for example, 3-pole earphone plug or 4-pole earphone plug) from a pair of earphones is inserted into a connector (for example, earphone plug socket of the electronic device). For example, the electronic device may perform an operation corresponding to operation 501 of FIG. 5.

In operation 1203, the electronic device (for example, the electronic device 101, the processor 120, the electronic device 201, the processor 400, or the program module 440) may acquire predetermined polarity information. According to an embodiment, the predetermined polarity information may be polarity information selected by the user. According to another embodiment, the pre-designated polarity information may be information associated with a sound path which can operate both non-microphone type earphones and microphone type earphones. According to another embodiment, the predetermined polarity information may be earphone polarity information randomly stored when the electronic device is manufactured, earphone polarity information used before the earphone insertion is detected, earphone polarity information which has a use number greater than or equal to a predetermined threshold value, earphone polarity information which has been most frequently used among stored earphone polarity information, and/or earphone polarity information having a history of use at the current location of the electronic device.

In operation 1205, the electronic device (for example, the electronic device 101, the processor 120, the electronic device 201, the processor 400, or the audio module 450) may set a sound path corresponding to the predetermined polarity information.

In operation 1207, the electronic device (for example, the electronic device 101, the processor 120, the electronic device 201, the processor 400, or the audio module 450) may operate the inserted earphones and/or speakers and microphones of the electronic device based on the set sound path.

According to one embodiment, a method of recognizing earphones by an electronic device may include an operation of detecting an insertion of earphones into a connector, an operation of setting a sound path for inputting or outputting a sound to or from the electronic device based on a predetermined polarity information.

According to one embodiment, the predetermined polarity information may be a first polarity information stored in the electronic device before the detection of the insertion of the earphones.

According to one embodiment, the method of recognizing earphones may include an operation of determining a second polarity information corresponding to the inserted earphones, determining whether the first polarity information is compatible with the second polarity information, and resetting the sound path based on the second polarity information when the first polarity information is not compatible with the second polarity information.

According to one embodiment, the predetermined polarity information may be at least one of a most recently used polarity information, a polarity information corresponding a number of uses greater than a threshold, a most frequently used polarity information, a polarity information corresponding to a location of the electronic device, a polarity information designated by a user, and a prioritized polarity information.

According to one embodiment, the predetermined polarity information may be polarity information of non-microphone type earphones.

According to one embodiment, the method of recognizing earphones may include an operation of, when the sound path is set based on polarity information of non-microphone type earphones and the inserted earphones are microphone type earphones, operating the inserted earphones o as non-microphone type earphones.

According to one embodiment, the microphone type earphones may include 4-pole type earphones and the non-microphone type earphones may include 3-pole type earphones.

A method of recognizing an external device and an electronic device for processing the method can prevent delay, which may be generated when a sound path is set, by presetting the sound path (for example, input path, output path, or input/output path) based on earphones polarity information used before earphone insertion is detected when the earphones are inserted.

A terminology "module" used for the present disclosure may mean, for example, a unit including a combination of one or two or more among a hardware, a software, or a firmware. A "module" may be interchangeably used with a terminology such as a unit, a logic, a logical block, a component, or a circuit, etc. A "module" may be a minimum unit of an integrally configured part or a portion thereof. A "module" may be a minimum unit performing one or more functions or a portion thereof. A "module" may be mechanically or electronically implemented. For example, a "module" according to the present disclosure may include at least one of an application-specific integrated circuit (ASIC) chip, a field-programmable gate arrays (FPGAs), or a programmable-logic device which are known, or to be developed in the future, and performing certain operations.

According to various embodiments, at least a portion of an apparatus (e.g., modules or functions thereof) or a method (e.g., operations) according to the present disclosure may be implemented as an instruction stored in a computer-readable storage media, for example, in the form of a programming module. An instruction, when executed by one or more processors (e.g., the processor 120), may allow the one or more processors to perform a function corresponding to the instruction. The computer-readable storage media may be, for example, the memory 130. At least a portion of a programming module may be implemented (e.g., executed) by, for example, the processor 120. At least a portion of the programming module may include, for example, a module, a program, a routine, sets of instructions, or a process, etc. for performing one or more functions.

The computer-readable storage media may include a hard disk, a magnetic media such as a floppy disk and a magnetic tape, Compact Disc Read Only Memory (CD-ROM), optical media such as Digital Versatile Disc (DVD), magneto-optical media such as a floptical disk, and a hardware device specially configured for storing and performing a program instruction (e.g., a programming module) such as Read Only Memory (ROM), Random Access Memory (RAM), a flash memory, etc. Also, the program instruction may include not only a machine language code generated by a compiler but also a high-level language code executable by a computer using an interpreter, etc. The above-described hardware device may be configured to operate as one or more software modules in order to perform an operation of the present disclosure, and vice versa.

A module or a programming module according to the present disclosure may include at least one of the above-described elements, omit a portion thereof, or further include additional other elements. Operations performed by a module, a programming module, or other elements according to the present disclosure may be executed in a sequential, parallel, or heuristic method. Also, a portion of the operations may be executed in a different sequence, omitted, or other operations may be added.

The above-described embodiments of the present disclosure can be implemented in hardware, firmware or via the execution of software or computer code that can be stored in a recording medium such as a CD ROM, a Digital Versatile Disc (DVD), a magnetic tape, a RAM, a floppy disk, a hard disk, or a magneto-optical disk or computer code downloaded over a network originally stored on a remote recording medium or a non-transitory machine readable medium and to be stored on a local recording medium, so that the methods described herein can be rendered via such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein. Any of the functions and steps provided in the Figures may be implemented in hardware, or a combination hardware configured with machine executable code and may be performed in whole or in part within the programmed instructions of a computer. No claim element herein is to be construed under the provisions of 35 U.S.C. 112, sixth paragraph, unless the element is expressly recited using the phrase "means for."

What is claimed is:

1. An electronic device comprising:

a memory; and a processor electrically coupled to the memory, wherein the processor executing instructions stored in the memory is configured to:

detect an insertion of earphones into a connector of the electronic device, determine first polarity information based on location information of the electronic device in response to detecting the insertion of the earphones, based on the first polarity information, set a sound path of the electronic device, determine second polarity information detected from the inserted earphones, determine whether a change of the sound path is required based on a comparison between the first polarity information and the second polarity information, and change the sound path based on the second polarity information in response to determining that the change of the sound path is required.

2. The electronic device of claim 1, wherein the first polarity information corresponds to polarity information stored in the memory before the insertion of the earphones is detected.

3. The electronic device of claim 1, wherein the processor is configured to operate the inserted earphones through the sound path set based on the first polarity information in response to determining that the change of the sound path is not required.

4. The electronic device of claim 1, wherein the processor is further configured to obtain identification information of the inserted earphones and to set a sound effect corresponding to the identification information, wherein the sound effect comprises at least one of a high sound field effect, a low sound field effect, or equalizing effect.

5. The electronic device of claim 4, wherein the processor is further configured to identify characteristics of the inserted earphones based on the identification information, and set the sound effect corresponding to the identified characteristics.

6. The electronic device of claim 1, wherein the processor is further configured to receive, from the inserted earphones, identification information of the inserted earphones, or obtain identification information by measuring a resistance value of the inserted earphones.

7. The electronic device of claim 1, wherein the processor is further configured to determine that the change of the sound path is not required when the first polarity information and the second polarity information are identical.

8. The electronic device of claim 1, wherein the processor is further configured to determine whether a change of the sound path is required based on a rule associated with the first polarity information and the second polarity information.

9. A method comprising:

detecting an insertion of earphones into a connector of an electronic device; and setting a sound path of the electronic device based on predetermined polarity information in response to detecting the insertion of the earphones, wherein the predetermined polarity information is determined based on polarity information corresponding to a location of the electronic device.

10. The method of claim 9, wherein the predetermined polarity information is first polarity information stored in the electronic device before the detection of the insertion of the earphones.

11. The method of claim 10, further comprising:

determining second polarity information detected from the inserted earphones;

determining whether a change of the sound path is required based on a comparison between the first polarity information and the second polarity information; and changing the sound path based on the second polarity information in response to determining that the change of the sound path is required.

12. The method of claim 9, wherein the predetermined polarity information is polarity information of non-microphone type earphones or microphone type earphones.

13. The method of claim 9, further comprising:

obtaining identification information of the inserted earphones; and setting a sound effect corresponding to the identification information, wherein the sound effect comprises at least one of a high sound field effect, a low sound field effect, or equalizing effect.

14. The method of claim 13, wherein the obtaining of the identification information comprising:

receiving, from the inserted earphones, the identification information of the inserted earphones; or obtaining identification information by measuring a resistance value of the inserted earphones.

15. An electronic device comprising:

a memory; and a processor electrically coupled to the memory, wherein the processor executing instructions stored in the memory is configured to:

detect an insertion of earphones into a connector of the electronic device, determine first polarity information based on location information of the electronic device in response to detecting the insertion of the earphones, and display the first polarity information on a screen of the electronic device, wherein the first polarity information is determined based on polarity information corresponding to a location of the electronic device.

16. The electronic device of claim 15, wherein the processor is further configured to:

set a sound path of the electronic device based on the first polarity information, determine second polarity information detected from the inserted earphones, determine whether a change of the sound path is required based on a comparison between the first polarity information and the second polarity information, and change the sound path based on the second polarity information in response to determining that the change of the sound path is required.

17. The electronic device of claim 16, wherein the processor is further configured to obtain identification information of the inserted earphones, and set a sound effect corresponding to the identification information, wherein the sound effect comprises at least one of a high sound field effect, a low sound field effect, or equalizing effect.

* * * * *